US008084143B2

(12) United States Patent
Yoshinaga et al.

(10) Patent No.: US 8,084,143 B2
(45) Date of Patent: Dec. 27, 2011

(54) HIGH-YIELD-RATIO AND HIGH-STRENGTH THIN STEEL SHEET SUPERIOR IN WELDABILITY AND DUCTILITY, HIGH-YIELD-RATIO HIGH-STRENGTH HOT-DIP GALVANIZED THIN STEEL SHEET, HIGH-YIELD RATIO HIGH-STRENGTH HOT-DIP GALVANNEALED THIN STEEL SHEET, AND METHODS OF PRODUCTION OF SAME

(75) Inventors: Naoki Yoshinaga, Kimitsu (JP); Shunji Hiwatashi, Kimitsu (JP); Yasuharu Sakuma, Kimitsu (JP); Atsushi Itami, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 65 days.

(21) Appl. No.: 10/574,053

(22) PCT Filed: Sep. 30, 2004

(86) PCT No.: PCT/JP2004/014790

§ 371 (c)(1),
(2), (4) Date: Mar. 29, 2006

(87) PCT Pub. No.: WO2005/031024

PCT Pub. Date: Apr. 7, 2005

(65) Prior Publication Data

US 2007/0029015 A1 Feb. 8, 2007

(30) Foreign Application Priority Data

Sep. 30, 2003 (JP) ..... 2003-341152
Sep. 30, 2003 (JP) ..... 2003-341456

(51) Int. Cl.
*C22C 38/12* (2006.01)
*C22C 38/14* (2006.01)

(52) U.S. Cl. ..... 428/659; 148/661; 148/330; 420/120; 420/121; 420/124

(58) Field of Classification Search ..... 148/320, 148/330, 331, 529, 530, 533, 601, 648, 654, 148/661; 420/89–93, 104–114, 120–128; 428/659
See application file for complete search history.

(56) References Cited

U.S. PATENT DOCUMENTS 6,364,968 B1 * 4/2002 Yasuhara et al. ..... 148/320

FOREIGN PATENT DOCUMENTS

| | | | |
|---|---|---|---|
| CA | 2433626 | | 7/2002 |
| CA | 2475950 | | 9/2003 |
| CN | 1148416 | A | 4/1997 |
| EP | 0 757 113 | B1 | 4/2000 |
| JP | 57-110650 | | 7/1982 |
| JP | 59-219473 | | 12/1984 |
| JP | 63-024013 | | 2/1988 |
| JP | 01-176029 | | 7/1989 |
| JP | 01-176030 | | 7/1989 |
| JP | 2000-080440 | * | 3/2000 |
| JP | 2000-1718681 | A | 6/2000 |
| JP | 2000-282175 | A | 10/2000 |
| JP | 2000-319750 | A | 11/2000 |
| JP | 2001-220647 | A | 8/2001 |
| JP | 2001-226741 | * | 8/2001 |
| JP | 2001-226741 | A | 8/2001 |
| JP | 2001-355043 | | 12/2001 |
| JP | 2001-355043 | A | 12/2001 |
| JP | 2002-129279 | A | 5/2002 |
| JP | 2003-193194 | * | 7/2003 |

OTHER PUBLICATIONS

Arnold R. Marder, Effects of Surface Treatments on Materials Performance, in Materials Selection and Design, vol. 20 of the ASM Handbook, (1997), p. 1-10.*
Chinese Office Action dated May 16, 2008 issued in corresponding Chinese Patent Application No. 2004800285566.
Canadian Office Action dated Jan. 29, 2009 issued in corresponding Canadian Application No. 2,540,762.
"Stretch-Flangeability of Cold-Rolled TRIP-Aided Bainitic Sheet Steels", CAMP-ISIJ vol. 13 (2000) p. 395.
"Effects of Microstructuires on Stretch-Flangeability of Ultra High Strengthened Col-rolled Steel Sheets" CAMP-ISIJ vol. 13 (2000) p. 391.
Cullity, B.D., "Elements of X-ray diffraction" New Version Cullity Scattering Theory of X-Ray, (1986), pp. 290 to 292.
Supplementary European Search Report dated Oct. 28, 2009, issued in corresponding European Patent Application No. 04773654.1.

* cited by examiner

*Primary Examiner* — George Wyszomierski
*Assistant Examiner* — Mark L Shevin
(74) *Attorney, Agent, or Firm* — Kenyon & Kenyon, LLP

(57) ABSTRACT

High yield ratio high-strength thin steel sheet superior in weldability and ductility characterized by: being comprised of steel containing, by mass %, C: over 0.030 to less than 0.10%, Si: 0.30 to 0.80%, Mn: 1.7 to 3.2%, P: 0.001 to 0.02%, S: 0.0001 to 0.006%, Al: 0.060% or less, N: 0.0001 to 0.0070%, containing further Ti: 0.01 to 0.055%, Nb: 0.012 to 0.055%, Mo: 0.07 to 0.55%, B: 0.0005 to 0.0040%, and simultaneously satisfying $1.1 \leqq 14\times Ti(\%)+20\times Nb(\%)+3\times Mo(\%)+300\times B(\%) \leqq 3.7$, the balance comprised or iron and unavoidable impurities, and having a yield ratio of 0.64 to less than 0.92, a $TS\times El^{1/2}$ of 3320 or more, an $YR\times TS\times EL^{1/2}$ of 2320 or more, and a maximum tensile strength (TS) of 780 MPa or more.

4 Claims, No Drawings

HIGH-YIELD-RATIO AND HIGH-STRENGTH THIN STEEL SHEET SUPERIOR IN WELDABILITY AND DUCTILITY, HIGH-YIELD-RATIO HIGH-STRENGTH HOT-DIP GALVANIZED THIN STEEL SHEET, HIGH-YIELD RATIO HIGH-STRENGTH HOT-DIP GALVANNEALED THIN STEEL SHEET, AND METHODS OF PRODUCTION OF SAME

TECHNICAL FIELD

The present invention relates to high-strength thin steel sheet high in yield ratio and superior in weldability and ductility, high-strength hot-dip galvanized thin steel sheet comprised of said thin steel sheet treated by hot-dip galvanizing, hot-dip galvannealed thin steel sheet treated by alloying suitable for automobiles, building materials, home electric appliances, etc. and methods of production of the same.

BACKGROUND ART

In recent years, demand for high-strength steel sheet with a good workability designed for improvement of the fuel efficiency and improvement of the durability of automobile frames and members has been rising. In addition, steel sheet of a tensile strength of the 780 MPa class or more is being used for frame parts or reinforcement or other members from the need for collision safety and expanded cabin space.

The first important thing with steel sheet for a frame is its spot weldability. Frame parts absorb impact at the time of collision and thereby function to protect the passengers. If a spot weld zone is not sufficient in strength, it will break at the time of collision and sufficient collision energy absorption performance will not be able to be obtained.

Technology regarding high-strength steel sheet considering weldability is, for example, disclosed in Japanese Patent Publication (A) No. 2003-193194 and Japanese Patent Publication (A) No. 2000-80440. Further, weldability is also studied in Japanese Patent Publication (A) No. 57-110650, but this only discusses flush butt weldability and does not disclose anything regarding technology for improving the spot weldability important in the present invention.

Next, a high yield strength is important. That is, a high yield ratio material is superior in collision energy absorption ability. To obtain a high yield ratio, making the structure a bainite structure is useful. Japanese Patent Publication (A) No. 2001-355043 discloses steel sheet having a bainite structure as a main phase and a method of production of the same.

Finally, the workability of the steel sheet, that is, the ductility, bendability, stretch flange formability, etc. are important. For example, "CAMP-ISIJ vol. 13 (2000) p. 395" discloses, regarding hole-expandability, that making the main phase bainite improves the hole-expandability and, regarding the punch stretch formability, that forming residual austenite in a second phase results in a punch stretchability on a par with current residual austenite steel.

Further, it discloses that if performing austempering at the Ms temperature or less to form 2 to 3 vol % residual austenite, the tensile strength×hole-expandability becomes maximum.

Further, to increase the ductility of high-strength materials, the general practice is to make positive use of a composite structure.

However, when using martensite or residual austenite as a second phase, the hole-expandability ends up remarkably dropping. This problem is for example disclosed in "CAMP-ISIJ vol. 13 (2000), p. 391".

Further, the above document discloses that if making the main phase ferrite, making the second phase martensite, and reducing the difference in hardness between the two, the hole-expandability is improved. Further, an example of steel sheet superior in hole-expandability and ductility is disclosed in Japanese Patent Publication (A) No. 2001 355043.

However, steel sheet having a tensile strength of 780 MPa or more provided with a high yield ratio and good ductility and further good in spot weldability cannot be said to have been sufficiently studied.

In particular, regarding spot weldability, with high-strength steel sheet, rather the weld zone strength falls. If welding by a welding current of the expulsion and surface flash region, the weld zone strength will remarkably drop or fluctuate. This problem is becoming a factor blocking expansion of the high-strength steel sheet market.

SUMMARY OF THE INVENTION

An object of the present invention is to provide thin steel sheet having a maximum tensile strength of 780 MPa or more, high in yield ratio, and provided with ductility and weldability enabling it to be used for automobile frame parts.

In the past, to meet the many needs required for steel sheet, improvement has been aimed at by so-called "impact addition" considering only the impacts of elements such as Si, Mn, Ti, Nb, Mo, and B on the main material, for example, only the strength or only the weldability, for each of the added elements and among the different elements.

However, these elements do not just affect the main material. They also have any effect on the secondary materials. For example, Mo has the action of "improving the weldability (effect on main material) and improving the strength, while lowering the ductility (effect on secondary materials)", so steel sheet in which a large number of these elements are added to satisfy all of the diversifying needs exhibits improvement due to the effect on the main material, but not the amount of improvement expected or exhibits unexpected deficiencies in performance due to the effect on secondary materials, that is, it was difficult to satisfy all of the needs.

To deal with this, upper and lower limits have been set for the amounts of addition of these elements, but even this cannot be said to be sufficient.

In particular, up to now there has not been any range of limitation of components satisfying all at once the high yield ratio and ductility and weldability required for recent automobile frame parts. This has become one of the challenges to be solved by R&D personnel.

Therefore, the inventors engaged in various studies to provide the above steel sheet and as a result took note of the relationship between the range of Si and specific elements and discovered that when Si is in a specific range considerably narrower than usual, by making the contents of Ti, Nb, Mo, and B specific ranges and making the total amount of addition within a suitable range by a relation using specific coefficients to balance the different elements with each other, a high yield ratio and ductility can both be achieved and weldability can also be provided and further discovered that by producing the sheet under suitable hot-rolling and annealing conditions, these performances can be improved more.

Regarding the yield ratio, the fact that a higher ratio is advantageous from the viewpoint of the collision absorption energy was explained above, but if too high, the shape freezability at the time of press formation becomes inferior, so it is important that the yield ratio not be 0.92 or more.

The present invention was completed based on the above discovery and has as its gist the following:

(1) High yield ratio high-strength thin steel sheet superior in weldability and ductility, characterized by: being comprised of steel containing, by mass%, C: over 0.030 to less than 0.10%, Si: 0.30 to 0.80%, Mn: 1.7 to 3.2%, P: 0.001 to 0.02%, S: 0.0001 to 0.006%, Al: 0.060% or less, N: 0.0001 to 0.0070%, containing further Ti: 0.01 to 0.055%, Nb: 0.012 to 0.055%, Mo: 0.07 to 0.55%, B: 0.0005 to 0.0040%, and simultaneously satisfying $1.1 \leqq 14 \leqq Ti(\%)+20\times Nb(\%)+3\times Mo(\%)+300\times B(\%) \leqq 3.7$, the balance comprised of iron and unavoidable impurities, and having a yield ratio of 0.64 to less than 0.92, a $TS\times El^{1/2}$ of 3320 or more, an $YR\times TS\times El^{1/2}$ of 2320 or more, and a maximum tensile strength (TS) of 780 MPa or more.

(2) High yield ratio high-strength thin steel sheet superior in weldability and ductility as set forth in (1), characterized by further containing, by mass%, one or two of Cr: 0.01 to 1.5%

Ni: 0.01 to 2.0%,

Cu: 0.001 to 2.0%,

Co: 0.01 to 1%,

W: 0.01 to 0.3%.

(3) High yield ratio high-strength hot-rolled steel sheet superior in weldability and ductility as set forth in (1) or (2), characterized in that said yield ratio is 0.68 to less than 0.92 and in that an X-ray intensity ratio of a {110} plane parallel to the sheet surface at ⅛ the thickness of the steel sheet is 1.0 or more.

(4) High yield ratio high-strength cold-rolled steel sheet superior in weldability and ductility as set forth in (1) or (2), characterized in that said yield ratio is 0.64 to less than 0.90 and in that an X-ray intensity ratio of a {110} plane parallel to the sheet surface at ⅛ the thickness of the steel sheet is less than 1.0.

(5) High yield ratio high-strength hot-dip galvanized steel sheet superior in weldability and ductility, characterized by comprising hot-rolled steel sheet comprised of the chemical components described in (3) and hot-dip galvanized.

(6) High yield ratio high-strength hot-dip galvanized steel sheet superior in weldability and ductility, characterized by comprising hot-rolled steel sheet comprised of the chemical components described in (3), hot-dip galvanized, and alloyed.

(7) High yield ratio high-strength hot-dip galvanized steel sheet superior in weldability and ductility characterized by comprising cold-rolled steel sheet comprised of the chemical components described in (4) and hot-dip galvanized.

(8) High yield ratio high-strength hot-dip galvanized steel sheet superior in weldability and ductility characterized by comprising cold-rolled steel sheet comprised of the chemical components described in (4), hot-dip galvanized, and alloyed.

(9) A method of production of high yield ratio high-strength hot-dip galvanized hot-rolled steel sheet superior in weldability and ductility, characterized by; heating a cast slab comprised of the chemical components described in (3) to 1160° C. or more directly or after once cooling, hot-rolling it ending at the $Ar_3$ transformation temperature or more, then cooling the sheet from the end of hot-rolling to 650° C. by an average cooling rate of 25 to 70° C./sec and coiling it at 700° C. or less in temperature.

(10) A method of production of high yield ratio high-strength hot-dip galvannealed hot-rolled steel sheet superior in weldability and ductility, characterized by; heating a cast slab comprised of the chemical components described in (5) to 1160° C. or more directly or after once cooling, hot-rolling it ending at the $Ar_3$ transformation temperature or more, cooling the sheet from the end of hot-rolling to 650° C. by an average cooling rate of 25 to 70° C./sec, coiling it at 700° C. or less in temperature, then running it through a hot-dip galvanizing line during which making the maximum heating temperature 500° C. to 950° C., cooling it to (zinc-coating bath temperature−40)° C. to (zinc-coating bath temperature+50)° C., then dipping it in a zinc-coating bath and giving it a skin-pass of a reduction rate of 0.1% or more.

(11) A method of production of high yield ratio high-strength hot-dip galvannealed hot-rolled steel sheet superior in weldability and ductility, characterized by; heating a cast slab comprised of the chemical components described in (6) to 1160° C. or more directly or after cooling once, hot-rolling it ending at the $Ar_3$ transformation temperature or more, cooling the sheet from the end of hot-rolling to 650° C. by an average cooling rate of 25 to 70° C./sec, coiling it at 700° C. or less in temperature, then running it through a hot-dip galvanizing line during which making the maximum heating temperature 500° C. to 950° C., cooling it to (zinc-coating bath temperature−40)° C. to (zinc-coating bath temperature+50)° C., then dipping it in a zinc-coating bath, then alloying it at 480° C. or more in temperature and giving a skin-pass of a reduction rate of 0.1% or more.

(12) A method of production of high yield ratio high-strength cold-rolled steel sheet superior in weldability and ductility, characterized by; heating a cast slab comprised of the chemical components described in (4) to 1160° C. or more directly or after once cooling, hot-rolling it ending at $Ar_3$ transformation temperature or more, cooling the sheet from the end of hot-rolling to 650° C. by an average cooling rate of 25 to 70° C./sec, coiling it at 750° C. or less in temperature, pickling it, then cold-rolling it at a reduction rate of 30 to 80%, running it through a continuous annealing line during which making the average heating rate until 700° C. 10 to 30° C./sec and making the maximum heating temperature 750° C. to 950° C., cooling in the cooling process after heating by an average cooling rate in the range of 500 to 600° C. of 5° C./sec or more, then giving it a skin-pass of a reduction rate of 0.1% or more.

(13) A method of production of high yield ratio high-strength hot-dip galvanized steel sheet superior in weldability and ductility, characterized by; heating a cast slab comprised of the chemical components described in (7) to 1160° C. or more directly or after cooling once, hot-rolling it ending at the $Ar_3$ transformation temperature or more, cooling the sheet from the end of hot-rolling to 650° C. by an average cooling rate of 25 to 70° C./sec, coiling it at 750° C. or less in temperature, pickling it, then cold-rolling it by a reduction rate of 30 to 80%, running it through a hot-dip galvanizing line during which making the average heating rate up to 700° C. 10 to 30° C./sec and making the maximum heating temperature 750° C. to 950° C., cooling it in the cooling process after heating by an average cooling rate in the range of 500 to 600° C. of 5° C./sec or more, cooling it to (zinc-coating bath temperature−40)° C. to (zinc-coating bath temperature+50)° C., dipping it in a zinc-coating bath, and giving it a skin-pass of a reduction rate of 0.1% or more.

(14) A method of production of high yield ratio high-strength hot-dip galvannealed steel sheet superior in weldability and ductility, characterized by; heating a cast slab comprised of the chemical components described in (8) to 1160° C. or more directly or after cooling once, hot-rolling it ending at the $Ar_3$ transformation temperature or more, cooling the sheet from the end of hot-rolling to 650° C. by a cooling rate of 25 to 70° C./sec, coiling at 750° C. in temperature, pickling it, then cold-rolling it by a reduction rate of 30 to 80%, running it through a hot-dip galvanizing line during which making the average heating rate up to 700° C. 10 to 30° C./sec and making the maximum heating temperature 750° C. to 950° C., cooling it in the cooling process after heating by an average cooling in the range of 500 to 600° C. of 5° C./sec or more, cooling it to (zinc-coating bath temperature−40)° C. to (zinc-coating bath temperature+50)° C., dipping it in a zinc-coating bath, then alloying it at 480° C. or more in temperature, and giving a skin-pass of a reduction rate of 0.1% or more.

THE MOST PREFERRED EMBODIMENT

Below, the present invention will be explained in detail.

First, the reasons for limitation of the chemical components of the cast slabs in the present invention will be explained. Note that "%" means "mass %".

C: over 0.030% to less than 0.10%

C is an element effective for obtaining high-strength, so addition over 0.030% is necessary. On the other hand, if 0.10% or more, the weldability deteriorates and, when used for frame parts of automobile frames and members, problems arise in terms of the bond strength or fatigue strength in some cases.

Further, if 0.10% or more, the hole-expandability deteriorates, so 0.10% is made the upper limit. 0.035 to 0.09% is a more preferable range.

Si: 0.30 to 0.80%

Si is important in the present invention. That is, Si must be 0.30 to 0.80%. Si is widely known as an element for improving the ductility. On the other hand, there is little knowledge of the effect of Si on the yield ratio or of the weldability. The range of the amount of Si is the range obtained as a result of study by the inventors.

Steel sheet never before seen, that is, with the effect of making the amount of Si this range, that is, provision of a predetermined yield ratio, ductility, and weldability, is first realized by the copresence of the later explained predetermined amount of Mn and the amounts of Ti, Nb, Mo, and B.

In particular, it is common knowledge that the weldability deteriorates if Si is added, but the inventors discovered that by adding Si in the copresence of the above-mentioned five types of element in this way, rather the TSS or CTS is improved and in particular good properties can be maintained in the expulsion and surface flash region.

In the present invention, good ductility and yield ratio are secured by adding 0.30% or more of Si. Further, Si suppresses the formation of relatively coarse carbides and improves the hole-expandability.

Excessive addition of Si degrades the coatability and also has a detrimental effect on the weldability, ductility, and yield ratio, so 0.80% is made the upper limit. 0.65% is a more preferable upper limit.

Mn: 1.7 to 3.2%

Mn suppresses the ferrite transformation and makes the main phase bainite or bainitic ferrite so acts to form a uniform structure. Further, it acts to lower the strength and to suppress the precipitation of carbides, one of the factors behind deterioration of the hole-expandability, and the formation of pearlite. Further, Mn is effective for improving the yield ratio.

Therefore, 1.7% or more is added. If less than 1.7%, composite addition with Si, Mo, Ti, Nb, and B cannot achieve both a high yield ratio and good ductility while with a low C.

However, excessive addition causes deterioration of the weldability and also promotes the formation of a large amount of martensite and invites a remarkable drop in the ductility and hole-expandability due to segregation etc., so 3.2% is made the upper limit. 1.8 to 2.6% is a more preferable range.

P: 0.001 to 0.02%

P is a strengthening element, but excessive addition causes the hole-expandability and bendability and further the weld zone bond strength or fatigue strength to deteriorate, so the upper limit is made 0.02%. On the other hand, excessively lowering the P is disadvantage economically, so 0.001% is made the lower limit. 0.003 to 0.014% in range is a more preferable range.

S: 0.0001 to 0.006%

Excessively lowering the S is disadvantageous economically, so 0.0001% is made the lower limit. On the other hand, addition over 0.006% has a detrimental effect on the steel sheet hole-expandability or bendability and further the weld zone bond strength or fatigue strength, so 0.006% is made the upper limit. More preferably, 0.003% is made the upper limit.

Al: 0.060% or less

Al is effective as a deoxidizing element, but excessive addition causes the formation of coarse Al-based inclusions, for example, alumina clusters, and degradation of the bendability and hole-expandability. For this reason, 0.060% is made the upper limit.

The lower limit is not particularly limited, but deoxidation is-performed by Al. Further, reducing the remaining amount of Al to 0.003% or less is difficult. Therefore, 0.003% is the substantive lower limit. When the deoxidation is performed by an element other than Al or an element other than Al is used together, however, this does not necessarily apply.

N: 0.0001 to 0.0070%

N is helpful for increasing the strength or imparting a BH property (baking hardening property), but if added in too great an amount, crude compounds are formed and the bendability and hole-expandability are degraded, so 0.0070% is made the upper limit.

On the other hand, making the amount less than 0.0001% is technically extremely difficult, so 0.0001% is made the lower limit. 0.0010 to 0.0040% is a more preferable range.

Ti: 0.01 to 0.055%

Nb: 0.012 to 0.055%

Mo: 0.07 to 0.55%

B: 0.0005 to 0.0040%

These elements are extremely important in the present invention. That is, by simultaneously adding these four types of elements with Si and Mn, a high yield ratio is obtained and the ductility required for shaping frame parts can be first secured.

Further, it is known that addition of Si or Mn degrades the weldability, but by simultaneously adding these four types of elements in predetermined amounts, a good weldability can be secured.

The fact that the above composite addition achieves the above effects was discovered for the first time by the inventors as a result of intensive study with the goal of creating steel provided with both weldability and ductility and further a high yield ratio.

The amounts of these element are determined from this viewpoint. Outside of this range, a sufficient effect cannot be obtained. A more preferable range is Ti: 0.018 to less than 0.030%, Nb: 0.017 to 0.036%, Mo: 0.08 to less than 0.30%, and B: 0.0011 to 0.0033%.

Further, by having the contents of Ti, Nb, Mo, and B satisfy the following relation in a specific range of Si $1.1 \leqq 14 \times Ti(\%) + 20 \times Nb(\%) + 3 \times Mo(\%) + 300 \times B(\%) \leqq 3.7$, more preferably, $1.5 \leqq 14 \times Ti(\%) + 20 \times Nb(\%) + 3 \times Mo(\%) + 300 \times B(\%) \leqq 2.8$, a high yield ratio and ductility and weldability can be secured with a good balance.

The reason why by satisfying the above relationship in a specific range of Si, a high yield ratio and ductility and weldability can be secured with a good balance is not clear, but it is believed that the strength of the ferrite and the hardness of the bainite are suitably balanced and the contradictory characteristics of a high yield ratio and good ductility can be both achieved.

Further, for the weld zone as well, it is believed that the distribution of the hardness of the nuggets and HAZ (heat affected zone) becomes smooth. The range of the above relationship was made 1.1 to 3.7. If less than 1.1, a high yield ratio is difficult to obtain and the weld strength also falls.

Further, if over 3.7, the ductility deteriorates, so 3.7 is made the upper limit. A more preferable range is $1.5 \leqq 14 \times Ti(\%) + 20 \times Nb(\%) + 3 \times Mo(\%) + 300 \times B(\%) \leqq 2.8$.

The yield ratio of the steel sheet obtained in the present invention is, with a hot-rolled steel sheet, 0.68 to less than 0.92 and, further, with a cold-rolled steel sheet, 0.64 to less than 0.90. If less than 0.68 in the case of hot-rolled steel sheet and if less than 0.64 in the case of cold-rolled steel sheet, a sufficient collision safety cannot be secured in some cases.

On the other hand, if 0.92 or more in the case of hot-rolled steel sheet and if 0.90 or more in the case of cold-rolled steel sheet, the shape freezability at the time of press formation deteriorates, so the upper limit is made less than 0.92 in the case of hot-rolled steel sheet and less than 0.90 in the case of cold-rolled steel sheet.

In the case of hot-rolled steel sheet, the ratio is more preferably 0.72 to 0.90, still more preferably 0.76 to 0.88. Further, in the case of cold-rolled steel sheet, the ratio is more preferably 0.68 to 0.88, still more preferably 0.74 to 0.86. Note that the yield ratio is evaluated by a JIS No. 5 tensile test piece having a direction perpendicular to the rolling direction as a tensile direction.

In the hot-rolled steel sheet of the present invention, an X-ray intensity ratio of a {110} plane parallel to the sheet surface at ⅛ the thickness of the steel sheet is 1.0 or more. Due to this, the drawability in the 45° direction with respect to the rolling direction is improved in some cases. Further, in the hot-rolled steel sheet of the present invention, to make the X-ray intensity ratio less than 1.0, lubrication rolling etc. is necessary and the cost rises. The above X-ray intensity ratio is preferably 1.3 or more.

In the cold-rolled steel sheet of the present invention, an X-ray intensity ratio of a {110} plane parallel to the sheet surface at ⅛ the thickness of the steel sheet is less than 1.0. If this X-ray intensity ratio is 1.0 or more, the formability deteriorates in some cases. Further, in the cold-rolled steel sheet of the present invention, to make the X-ray intensity ratio 1.0 or more, special rolling or annealing is necessary and the cost rises. The above X-ray intensity ratio is preferably less than 0.8.

Note that the measurement of the planar X-ray intensity ratio may for example be performed by the method described in New Version Cullity Scattering Theory of X-Ray (issued 1986, translated into Japanese by Gentaro Matsumura, Agne), pp. 290 to 292.

The "planar intensity ratio" means the value of the {110} plane X-ray intensity of the steel sheet of the present invention indexed to the {110} plane X-ray intensity of a standard sample (random orientation sample).

"⅛ the thickness of the steel sheet" means the plane ⅛ of the thickness inside from the surface of the sheet toward the center when designating the total sheet thickness as "1". When preparing the samples, it is difficult to accurately cut away ⅛ of the layer, so a range of 3/32 to 5/32 the thickness of the steel sheet is defined as ⅛ the thickness.

At the time of preparation of the samples, the samples are roughly finished by machine polishing, finished by #800 to 1200 or so abrasive paper, and finally stripped of 20 microns or more in thickness by chemical polishing.

The spot weldability of the steel sheet obtained by the present invention is characterized by a small margin of deterioration of the tensile load (CTS) compared with the CTS by a cross-joint tensile test when welding by a welding current immediately before expulsion and surface flash even it the welding current becomes the expulsion and surface flash region.

That is, with ordinary steel sheet, if welding accompanied with expulsion and surface flash, the CTS sharply drops and the fluctuation of the CTS becomes greater, while in the steel sheet of the present invention, the rate of drop and fluctuation of the CTS become small.

When indexed to the minimum value of CTS of 10 test pieces welded by a welding current immediately before expulsion and surface flash (CE) as "1", the minimum value of the CTS of 10 test pieces welded by a welding current of the region of occurrence of expulsion and surface flash, that is, (CE+1.5) kA, is made 0.7 or more.

The minimum value is preferably 0.8 or more, more preferably 0.9 or more. Note that CTS is evaluated based on the method of JIS Z 3137.

Next, the requirements defined in the invention of the above (2) will be explained.

Cr: 0.01 to 1.5%

Cr is effective for increasing the strength and also improves the bendability and hole-expandability through the suppression of formation of carbides and through the formation of bainite and bainitic ferrite. Further, Cr is also an element resulting in small degradation of the weldability in proportion to the effect on increasing the strength, so is added in accordance with need.

If added in an amount of less than 0.01%, no remarkable effect can be obtained, so 0.01% is made the lower limit. On the other hand, if added in an amount of over 1.5%, it has a detrimental effect on the workability and coatability, so 1.5% is made the upper limit. Preferably, the amount is 0.2 to 0.8%.

Ni: 0.01 to 2.0%

Cu: 0.001 to 2.0%

The steel sheet of the present invention may also contain Cu and/or Ni for the purpose of improving the coatability without having a detrimental effect on the strength-expandability balance. Ni is added in an amount of 0.01% or more for the purpose of not only improving the coatability, but also improving the hardenability.

On the other hand, addition in an amount of over 2.0% increases the alloy cost and has a detrimental effect on the workability, in particular contributes to a rise in hardness along with formation of martensite, so 2.0% is made the upper limit.

Cu is added in an amount of 0.001% or more not only for improving the coatability, but also for the purpose of improving the strength. On the other hand, if added in an amount of over 2.0%, it has a detrimental effect on the workability and recyclability, so 2.0% is made the upper limit.

In the case of the steel sheet of the present invention, Si is included, so making the amount of Ni 0.2% or more and/or the amount of Cu 0.1% or more is preferable from the viewpoints of the coatability and alloying reactivity.

Co: 0.01 to 1%

W: 0.01 to 0.3%

The steel sheet of the present invention may further contain one or both of Co and W.

Co is added in an amount of 0.01% or more for maintaining a good balance of the strength-expandability (and bendability) by control of bainite transformation. However, Co is an expensive element. Addition of a large amount impairs the economicalness, so addition of 1% or less is preferable.

W has a strengthening effect at 0.01% or more, so the lower limit is made 0.01%. On the other hand, addition over 0.3% has a detrimental effect on the workability, so 0.3% is made the upper limit.

Further, the steel sheet of the present invention may include, for further improving the balance of the strength and hole-expandability, one or more of the strong carbide-forming elements Zr, Hf, Ta, and V in a total of 0.001% or more. On the other hand, large addition of these elements invites deterioration of the ductility and hot workability, so the upper limit of the total amount of addition of one or more of these is made 1%.

Further, Ca, Mg, La, Y, and Ce contribute to control of inclusions, in particular fine dispersion, by addition in suitable quantities, so one or more of these elements may be added in a total amount of 0.0001% or more. On the other hand, excessive addition of these elements causes a drop in the castability, hot workability, and other production properties and the ductility of the steel sheet product, so 0.5% is made the upper limit.

REMs other than La, Y, and Ce contribute to control of inclusions, in particular fine dispersion, by addition in suitable quantities, so in accordance with need, 0.0001% or more is added. On the other hand, excessive addition of the above REMs not only leads to increased cost, but also reduces the castability, hot workability, and other production properties and the ductility of the steel sheet product, so 0.5% is made the upper limit.

As unavoidable impurities, for example, there are Sn, Sb, etc., but even if these elements are included in a total of 0.2% or less, the effect of the present invention is not impaired.

O is not particularly limited, but if a suitable quantity is included, it is effective for improving the bendability and hole-expandability. On the other hand, if too great, conversely it degrades these characteristics, so the amount of O is preferably made 0.0005 to 0.004%.

The steel sheet is not particularly limited in microstructure, but to obtain a high yield ratio and good ductility, bainite or bainitic ferrite is suitable as the main phase. This is made 30% or more in area rate.

The "bainite" referred to here includes upper bainite where carbides are formed at the lath boundaries and lower bainite where fine carbides are formed in the laths.

Further, bainitic ferrite means carbide-free bainite. For example, acicular ferrite is one example.

To improve the hole-expandability and bendability, it is preferable that lower bainite with carbides finely dispersed in it or bainitic ferrite or ferrite with no carbides form the main phase and have an area rate of over 85%.

In general, ferrite is soft and reduces the yield ratio of the steel sheet, but this does not apply to high dislocation density ferrite such as unrecrystallized ferrite.

Note that the above microstructure phases, ferrite, bainitic ferrite, bainite, austenite, martensite, interfacial oxidation phase, and residual structure may be identified, the positions of presence may be observed, and the area rates may be measured by using a Nytal reagent and a reagent disclosed in Japanese Patent Publication (A) No. 59-219473 to corrode the steel sheet in the cross section in the rolling direction or cross section in a direction perpendicular to the rolling and observing it by a 500× to 1000× power optical microscope and/or observing it by a 1000× to 100000× electron microscope (scan type and transmission type).

At least 20 fields each can be observed and the point count method or image analysis used to find the area rate of the different phases.

$TS \times El^{1/2}$ is preferably $TS \times El^{1/2} \leqq 3320$ for obtaining a superior ductility assuming a high-strength steel sheet having a tensile strength of 780 MPa or more. If less than 3320, the ductility cannot be secured in many cases and the balance of strength and ductility is lost.

Further, $YR \times TS \times El^{1/2}$ is preferably $YR \times TS \times El^{1/2} \geqq 2320$ or more in order to obtain a high yield ratio and superior ductility assuming a high-strength steel sheet having a tensile strength of 780 MPa or more. If less than 2320, the yield ratio or ductility cannot be secured in many cases and the balance is poor.

Next, the inventions of the above (9), (10), and (11), that is, the methods of production of the high yield ratio high-strength hot-rolled steel sheet superior in weldability and ductility, high yield ratio high-strength hot-dip galvanized hot-rolled steel sheet, and high yield ratio high-strength hot-dip galvannealed hot-rolled steel sheet will be explained.

The steel components may be adjusted by the usual blast furnace-converter method or an electric furnace etc.

The casting method is also not particularly limited. The usual continuous casting method, ingot method, or thin slab casting may be used to produce a cast slab.

The cast slab may be cooled once, reheated, then hot-rolled or may be directly hot-rolled without cooling.

Once the temperature falls below 1160° C., the sheet is heated to 1160° C. or more. If the heating temperature is less than 1160° C., due to segregation and other effects, the product deteriorates in bendability and hole-expandability, so 1160° C. is made the lower limit. Preferably, the temperature is made 1200° C. or more, more preferably 1230° C. or more.

The final finishing temperature of the hot-rolling is made the $Ar_3$ transformation temperature or more, If this temperature becomes less than the $Ar_3$ transformation temperature, the hot-rolled sheet is formed with ferrite grains flattened in the rolling direction and the ductility and bendability deteriorate.

The sheet is cooled from the end of hot-rolling to 650° C. by an average cooling rate of 25 to 70° C./sec. If less than 25° C./sec, a high yield ratio becomes difficult to obtain, while if over 70° C./sec, the ductility deteriorates in some cases. 35 to 50° C./sec is a more preferable range.

After the hot-rolling, the sheet is coiled at 700° C. or less. If this coiling temperature is over 700° C., the hot-rolled structure is formed with ferrite or pearlite in large quantities and a high yield ratio cannot be obtained. The coiling temperature is preferably 650° C. or less. 600° C. is more preferable.

The lower limit of the coiling temperature is not particularly set, but making it less than room temperature is difficult, so room temperature is made the lower limit. If considering securing the ductility, 400° C. or more is more preferable.

Note that roughly rolled bars may be joined for continuous finishing hot-rolling. At this time, the roughly rolled bar may be coiled up once.

The thus produced hot-rolled steel sheet is pickled, then the steel sheet may be given a skin-pass in accordance with need. To correct the shape, improve the ordinary temperature aging resistance, adjust the strength, etc., it may be performed up to a reduction rate of 4.0%.

If the reduction rate is over 4.0%, the ductility remarkably deteriorates, so 4.0% is made the upper limit. On the other hand, if the reduction rate is less than 0.1%, the effect is small and control is difficult, so 0.1% is the lower limit.

The skin-pass may be given in-line or off-line. Further, the skin-pass may be performed at the target reduction rate once or may be given divided into several operations.

When running the thus produced hot-rolled steel sheet through the hot-dip galvanizing line to give a hot-dip galvanizing, the maximum heating temperature is made 500° C. to 950° C. If less than 500° C., when the steel sheet is inserted into the coating bath, the steel sheet temperature ends up becoming 400° C. As a result, the coating bath temperature falls and the productivity falls.

On the other hand, if over 950° C., sheet breakage and degradation of the surface conditions are induced, so 950° C. is made the upper limit. 600° C. to less than 900° C. is a more preferable range.

In the case of a hot-dip galvanizing line comprised of a so-called nonoxidizing furnace (NOF)-reducing furnace (RF), making the air ratio in the nonoxidizing furnace 0.9 to 1.2 promotes oxidation of the iron, enables the iron oxide at the surface to be converted to metal iron by the following reduction treatment, and thereby enables improvement of the coatability and alloying reactivity.

Further, in a hot-dip galvanizing line of a type with no NOF, making the condensation point−20° C. or more works effectively for coatability and alloying reactivity.

The sheet temperature before dipping in the coating bath is important for maintaining the coating bath temperature constant and securing production efficiency. A (zinc-coating bath temperature−40)° C. to (zinc-coating bath temperature+50)° C. in range is preferable, while a (zinc-coating bath temperature−10)° C. to (zinc-coating bath temperature+30)° C. is more preferable in range. If this temperature is less than (zinc-coating bath temperature−40)° C., the yield ratio will fall below 0.68 in some cases.

After this alloying treatment, the sheet is heated to a temperature of 480° C. or more and the zinc-coating layer is reacted with iron to obtain a Zn-Fe alloy layer. If this temperature is less than 480° C., the alloying reaction does not sufficiently progress, so 480° C. is made the lower limit.

The upper limit is not particularly provided, but if 600° C. or more, the alloying proceeds too much and the coating layer easily peels off, so less than 600° C. is preferable.

After the hot-dip galvanizing or after the alloying treatment, to correct the shape, improve the ordinary temperature aging resistance, adjust the strength, etc., a skin-pass of a 0.1% or greater reduction rate is given. If less than 0.1%, a sufficient effect cannot be obtained. The upper limit of the reduction rate is not particularly provided. In accordance with need, a skin-pass of up to a reduction rate of 5% is given. The skin-pass may be performed either in-line or off-line and may be given divided into a plurality of operations.

The hot-rolled steel sheet of the present invention is superior in weldability as well. As explained above, it exhibits particularly superior properties with respect to spot welding. In addition, it is also compatible with the usually performed welding methods, for example, arc, TIG, MIG, mash seam, laser, and other welding methods.

The hot-rolled steel sheet of the present invention is also suitable for hot pressing. That is, the steel sheet may be heated to 900° C. or more in temperature, then press formed and quenched to obtain a shaped product with a high yield ratio. Further, this shaped product is also superior in subsequent weldability. Further, the hot-rolled steel sheet of the present invention is also superior in resistance to hydrogen embrittlement.

Next, the inventions of the above (12), (13), and (14), that is, the methods of production of high yield ratio high-strength cold-rolled steel sheet superior in weldability and ductility, high yield ratio high-strength hot-dip galvanized steel sheet, and high yield ratio high-strength hot-dip galvannealed steel sheet will be explained.

The steel components may be adjusted by the usual blast furnace-converter method or also electric furnace etc.

The casting method is also not particularly limited. The usual continuous casting method or ingot method or thin slab casting may be used to produce a cast slab.

The cast slab may be cooled once, reheated, then hot-rolled. It may also be directly hot-rolled without cooling. Once becoming less than 1160° C., it is heated to 1160° C. or more.

If the heating temperature is less than 1160° C., due to segregation and other effects, the product deteriorates in bendability and hole-expandability, so 1160° C. is made the lower limit. Preferably, the temperature is made 1200° C. or more, more preferably 1230° C. or more.

The final finishing temperature of hot-rolling is made the $Ar_3$ transformation temperature or more. If this temperature is less than the $Ar_3$ transformation temperature, the hot-rolled sheet ends up with ferrite particles flattened in the rolling direction and the ductility and bendability deteriorate.

The sheet is cooled from the end of hot-rolling to 650° C. by an average cooling rate of 25 to 70° C./sec. If less than 25° C./sec, a high yield ratio becomes difficult to obtain, while conversely if over 70° C./sec, the cold ductility and sheet shape become inferior or the ductility deteriorates in some cases. 35 to 50° C./sec is a more preferable range.

After hot-rolling, the sheet is coiled at 750° C. or less. If the temperature is over 750° C., the hot-rolled structure contains a large amount of ferrite or pearlite, the final product becomes uneven in structure, and the bendability and hole-expandability drop. The coiling temperature is preferably 650° C. or less, more preferably 600° C. or less.

The lower limit of the coiling temperature is not particularly set, but making it less than room temperature is difficult, so room temperature is made the lower limit. If considering securing ductility, 400° C. or more is more preferable.

Note that roughly rolled bars may be joined for continuous finishing hot-rolling. At this time, the roughly rolled bar may be coiled up once.

The thus produced hot-rolled steel sheet is pickled, then said steel sheet may be given a skin-pass in accordance with need. To correct the shape, improve the ordinary temperature aging resistance, adjust the strength, etc., it may be performed up to a reduction rate of 4.0%. If the reduction rate is over 4.0%, the ductility remarkably deteriorates, so 4.0% is made the upper limit.

On the other hand, if the reduction rate is less than 0.1%, the effect is small and the control becomes difficult, so 0.1% is the lower limit.

The skin-pass may be given in-line or off-line. Further, it is possible to give a skin-pass of the targeted reduction rate at once time or divided into several times.

The pickled hot-rolled steel sheet is cold-rolled by a reduction rate of 30 to 80% and run through a continuous annealing line or hot-dip galvanizing line. If the reduction rate is less than 30%, the shape is hard to maintain flat. Further, if the reduction rate is less than 30%, the final product deteriorates in ductility, so the reduction rate is made 30% as a lower limit.

On the other hand, if making the reduction rate 80% or more, the cold-rolling load becomes extremely large, so the productivity is obstructed. 40 to 70% is a preferable reduction rate.

When run through a continuous annealing line, the average heating rate up to 700° C. is made 10 to 30° C./sec. If the average heating rate is less than 10° C./sec, the high yield ratio becomes difficult to obtain, while conversely if over 30° C./sec, a good ductility becomes difficult to secure in some cases. The reason is not clear, but is believed to be related to the recovery behavior of dislocation during heating.

The maximum heating temperature in the case of running through a continuous annealing line is 750 to 950° C. If less than 750° C., $\alpha \rightarrow \gamma$ transformation will not occur or will occur only slightly, so the final structure cannot be made a transformed structure, the yield ratio will not become high, and the elongation will be inferior. Accordingly, a maximum heating temperature of 750° C. is made the lower limit.

On the other hand, if the maximum heating temperature becomes over 950° C., the sheet deteriorates in shape and other trouble is induced, so 950° C. is made the upper limit.

The heat treatment time in this temperature region is not particularly limited, but for making the temperature of the steel sheet uniform, 1 sec or more is necessary. However, if the heat treatment time is over 10 minutes, formation of grain interfacial oxidation phases is promoted and a rise in cost is invited, so a heat treatment time of 10 minutes or less is preferable.

In the cooling process after heating, the sheet is cooled by an average cooling rate in the range of 500 to 600° C. of 5° C./sec or more. If less than 5° C./sec, pearlite is formed, the yield ratio is lowered, and the bendability and stretch flange formability is degraded in some cases.

After this, in accordance with need, the sheet may be heat treated by holding it at 100 to 550° C. in range for 60 sec or more. Due to this heat treatment, the elongation and bendability are improved in some cases. If the heat treatment temperature is less than 100° C., the effect is small. On the other hand, making it 550° C. or more is difficult. Preferably, it is 200 to 450° C.

The reduction rate in the skin-pass rolling after heat treatment is made 0.1% or more. If the reduction rate is less than 0.1%, a sufficient effect cannot be obtained. An upper limit of the reduction rate is not particularly set, but in accordance with need, the skin-pass is performed up to a reduction rate of 5%. The skin-pass may be given in-line or off-line and may be given divided into a plurality of operations. The more preferable range of the reduction rate is 0.3 to 2.0%. After the heat treatment, the sheet may be given various types of platings or coatings.

The average heating rate and maximum peak temperature up to 700° C. when running the sheet through a hot-dip galvanizing line after cold-rolling are made an average heating rate up to 700° C. of 10 to 30° C./sec and a maximum heating temperature of 750 to 950° C. for the same reason as the case of running it through a continuous annealing line.

In the case of a hot-dip galvanizing line comprised of a so-called nonoxidizing furnace (NOF)-reducing furnace (RF), making the air ratio in the nonoxidizing furnace 0.9 to 1.2 promotes oxidation of the iron, enables the iron oxide at the surface to be converted to metal iron by the following reduction treatment, and thereby enables improvement of the coatability and alloying reactivity.

Further, in a hot-dip galvanizing line of a type with no NOF, making the condensation point−20° C. or more works effectively for coatability and alloying reactivity.

In the cooling process after heating, the sheet is cooled in the range of 500 to 600° C. by a cooling rate of 5° C./sec or more. If less than 5° C./sec, pearlite forms, the yield ratio is lowered, and the bendability and elongation flange formability are degraded in some cases.

The cooling stopping temperature after reaching the maximum heating temperature and before dipping in the coating bath is made (zinc-coating bath temperature−40)° C. to (zinc-coating bath temperature+50)° C. If this temperature is less than (zinc-coating bath temperature-40)° C., the yield ratio falls below 0.64 in some cases. Not only this, the heat loss at the time of dipping in the coating bath is large and therefore problems arise in operation.

Further, if the cooling stopping temperature exceeds (zinc-coating bath temperature+50)° C., the rise in the coating bath temperature leads to problems in operation. The zinc-coating bath may also contain elements other than zinc in accordance with need.

Further, when performing the alloying treatment, the treatment is performed at 480° C. or more. If the alloying temperature is less than 480° C., the progress of the alloying is slow and the productivity is poor. The upper limit of the alloying treatment temperature is not particularly limited, but if over 600° C., pearlite transformation occurs, the yield ratio falls, and the bendability and hole-expandability deteriorate, so 600° C. is the substantive upper limit.

The hot-dip galvanized steel sheet may also be given a skin-pass. If the reduction rate of the skin-pass is less than 0.1%, a sufficient effect cannot be obtained. The upper limit of the reduction rate is not particularly set, but in accordance with need a skin-pass is given up to a reduction rate of 5%. The skin-pass may be given in-line or off-line or may be given divided into a plurality of operations. The more preferable range of the reduction rate is 0.3 to 2.0%.

The cold-rolled steel sheet of the present invention is also superior in weldability and, as explained above, exhibits particularly superior properties with respect to spot welding and is also suitable for other usually performed welding methods such as arc, TIG, MIG, mash seam, laser, and other welding methods.

The cold-rolled steel sheet of the present invention is also suitable for hot pressing. That is, it is possible to heat the steel sheet to 900° C. or more in temperature, then press form and quench it to obtain a shaped product with a high yield ratio. Further, this shaped product is also superior in subsequent weldability. Further, the cold-rolled steel sheet of the present invention is also superior in resistance to hydrogen embrittlement.

Below, examples will be used to explain the present invention in further detail.

EXAMPLES

Examples 1 to 4 are examples according to the hot-rolled steel sheet of the present invention.

Example 1

Each of the chemical compositions shown in Table 1 was adjusted in the converter to obtain a slab. The slab was heated to 1240° C. and hot-rolled ending at more than the $Ar_3$ transformation temperature, that is, 890° C. to 910° C., to a steel strip of a thickness of 1.8 mm, and coiled at 600° C.

This steel sheet was pickled, then given a skin-pass of a reduction rate shown in Table 2. JIS No. 5 tensile strength test pieces were obtained from this steel sheet and measured for tensile properties in a direction perpendicular to the rolling direction.

The spot welding was performed under the next conditions (a) to (e).

(a) Electrode (dome type): tip diameter 8 mmϕ

(b) Applied pressure: 5.6 kN (c) Welding current: current (CE) right before expulsion and surface flash and (CE+1.5)kA (d) Welding time: 17 cycles (e) Holding time: 10 cycles After welding, JIS Z 3137 was used for a cross-joint tensile test.

When indexed to the minimum value of CTS when welding test pieces by a welding current of CE 10 times as "1", a minimum value of the CTS when welding by a welding current of the region of occurrence of expulsion and surface flash, that is, (CE+1.5)kA, of less than 0.7 is evaluated as P (poor), of 0.7 to less than 0.8 as G (good), and of 0.8 or more as VG (very good).

The steel sheet of the present invention is superior in weldability, high in yield ratio, and relatively superior in ductility as well.

TABLE 1

| | C | Si | Mn | P | S | Al | N | Ti | Nb | Mo | B | Others | Remarks |
|---|---|---|---|---|---|---|---|---|---|---|---|---|---|
| A-1 | 0.033 | 0.59 | 2.10 | 0.005 | 0.0022 | 0.031 | 0.0026 | 0.022 | 0.019 | 0.29 | 0.0030 | | Inv. ex. |
| A-2 | 0.034 | 0.57 | 2.09 | 0.004 | 0.0028 | 0.030 | 0.0025 | 0.003 | 0.020 | 0.30 | 0.0028 | | Comp. ex. |
| B-1 | 0.039 | 0.56 | 2.10 | 0.004 | 0.0024 | 0.028 | 0.0029 | 0.020 | 0.022 | 0.14 | 0.0025 | | Inv. ex. |
| B-2 | 0.035 | 0.55 | 2.13 | 0.005 | 0.0025 | 0.029 | 0.0030 | 0.019 | 0.020 | 0.30 | — | | Comp. ex. |
| C-1 | 0.052 | 0.54 | 2.12 | 0.006 | 0.0031 | 0.028 | 0.0020 | 0.019 | 0.022 | 0.14 | 0.0019 | | Inv. ex. |
| C-2 | 0.050 | 0.54 | 2.08 | 0.005 | 0.0020 | 0.024 | 0.0025 | 0.020 | — | 0.15 | 0.0020 | | Comp. ex. |
| D-1 | 0.044 | 0.55 | 2.14 | 0.004 | 0.0026 | 0.025 | 0.0031 | 0.022 | 0.021 | 0.15 | 0.0022 | | Inv. ex. |
| D-2 | 0.042 | 0.56 | 2.16 | 0.005 | 0.0025 | 0.027 | 0.0022 | 0.015 | 0.019 | — | 0.0033 | | Comp. ex. |
| E-1 | 0.050 | 0.55 | 2.00 | 0.003 | 0.0024 | 0.030 | 0.0025 | 0.025 | 0.018 | 0.16 | 0.0030 | | Inv. ex. |
| E-2 | 0.050 | 0.55 | 2.01 | 0.004 | 0.0024 | 0.027 | 0.0023 | 0.023 | 0.021 | — | — | | Comp. ex. |
| E-3 | 0.049 | 0.28 | 1.98 | 0.004 | 0.0026 | 0.030 | 0.0028 | 0.024 | 0.019 | 0.15 | 0.0027 | | Comp. ex. |
| F-1 | 0.047 | 0.60 | 1.84 | 0.005 | 0.0019 | 0.034 | 0.0026 | 0.021 | 0.026 | 0.25 | 0.0024 | Cr = 0.46 | Inv. ex. |
| F-2 | 0.046 | 0.62 | 1.66 | 0.006 | 0.0030 | 0.024 | 0.0028 | 0.024 | 0.024 | 0.30 | 0.0030 | Cr = 0.67 | Comp. ex. |
| G-1 | 0.062 | 0.84 | 2.09 | 0.011 | 0.0016 | 0.029 | 0.0028 | 0.020 | 0.042 | 0.14 | — | | Comp. ex. |
| G-2 | 0.111 | 0.01 | 1.74 | 0.008 | 0.0026 | 0.030 | 0.0025 | 0.011 | 0.042 | — | — | | Comp. ex. |
| H-1 | 0.070 | 0.55 | 2.41 | 0.008 | 0.0023 | 0.022 | 0.0024 | 0.020 | 0.052 | 0.09 | 0.0011 | | Inv. ex. |
| H-2 | 0.075 | 1.33 | 2.25 | 0.008 | 0.0024 | 0.020 | 0.0029 | 0.020 | 0.020 | 0.08 | 0.0009 | | Comp. ex. |
| I-1 | 0.060 | 0.60 | 2.10 | 0.007 | 0.0020 | 0.034 | 0.0026 | 0.020 | 0.020 | 0.30 | 0.0030 | | Inv. ex. |
| I-2 | 0.061 | 0.58 | 2.08 | 0.006 | 0.0024 | 0.030 | 0.0034 | — | — | 0.35 | 0.0033 | | Comp. ex. |
| J-1 | 0.050 | 0.59 | 2.49 | 0.007 | 0.0021 | 0.030 | 0.0030 | 0.020 | 0.050 | 0.15 | 0.0031 | | Inv. ex. |
| J-2 | 0.123 | 0.52 | 2.51 | 0.007 | 0.0022 | 0.021 | 0.0027 | — | — | — | — | | Comp. ex. |
| K-1 | 0.085 | 0.60 | 2.52 | 0.004 | 0.0032 | 0.029 | 0.0023 | 0.019 | 0.021 | 0.15 | 0.0025 | | Inv. ex. |
| K-2 | 0.090 | 0.01 | 2.60 | 0.004 | 0.0029 | 0.028 | 0.0026 | 0.041 | 0.016 | 0.15 | 0.0023 | | Comp. ex. |
| L-1 | 0.081 | 0.61 | 2.49 | 0.011 | 0.0027 | 0.029 | 0.0027 | 0.020 | 0.022 | 0.14 | 0.0025 | Cr = 0.40 | Inv. ex. |
| L-2 | 0.082 | 0.60 | 2.50 | 0.008 | 0.0031 | 0.027 | 0.0028 | 0.022 | 0.020 | 0.15 | — | Cr = 0.40 | Comp. ex. |
| M-1 | 0.074 | 0.55 | 2.65 | 0.003 | 0.0020 | 0.024 | 0.0021 | 0.023 | 0.040 | 0.30 | 0.0032 | | Inv. ex. |
| M-2 | 0.076 | 0.55 | 2.66 | 0.005 | 0.0019 | 0.025 | 0.0028 | 0.020 | 0.068 | 0.29 | 0.0026 | Sn = 0.03 | Comp. ex. |
| N-1 | 0.089 | 0.60 | 2.44 | 0.004 | 0.0021 | 0.027 | 0.0026 | 0.018 | 0.022 | 0.15 | 0.0019 | | Inv. ex. |
| N-2 | 0.091 | 0.60 | 2.45 | 0.004 | 0.0018 | 0.030 | 0.0022 | 0.122 | 0.021 | 0.16 | 0.0022 | Cr = 0.11 | Comp. ex. |
| O-1 | 0.079 | 0.58 | 2.51 | 0.004 | 0.0026 | 0.033 | 0.0028 | 0.015 | 0.016 | 0.15 | 0.0016 | V = 0.07 | Inv. ex. |
| O-2 | 0.150 | 0.51 | 2.62 | 0.006 | 0.0022 | 0.026 | 0.0033 | — | — | — | — | | Comp. ex. |
| P-1 | 0.096 | 0.58 | 3.03 | 0.008 | 0.0016 | 0.007 | 0.0030 | 0.029 | 0.020 | 0.40 | 0.0029 | V = 0.044 | Inv. ex. |
| P-2 | 0.153 | 0.72 | 2.98 | 0.007 | 0.0026 | 0.011 | 0.0025 | 0.016 | — | 0.09 | — | Ca = 0.0022 | Comp. ex. |

TABLE 2

| | Skin-pass reduction rate % | TS, MPa | YS, MPa | El % | YR | TS * $El^{1/2}$ | YR * TS * $El^{1/2}$ | (110)* | Spot weldability | Remarks |
|---|---|---|---|---|---|---|---|---|---|---|
| A-1 | 0.5 | 855 | 712 | 17 | 0.83 | 3525 | 2936 | 2.6 | VG | Inv. ex. |
| A-2 | 0.5 | 822 | 536 | 17 | 0.65 | 3389 | 2210 | 1.5 | VG | Comp. ex. |
| B-1 | 0.5 | 861 | 738 | 16 | 0.86 | 3444 | 2952 | 2.8 | VG | Inv. ex. |
| B-2 | 0.5 | 839 | 555 | 16 | 0.66 | 3356 | 2220 | 2.9 | G | Comp. ex. |
| C-1 | 0.5 | 880 | 717 | 15 | 0.81 | 3408 | 2777 | 2.7 | VG | Inv. ex. |
| C-2 | 0.5 | 904 | 582 | 14 | 0.64 | 3382 | 2178 | 1.8 | G | Comp. ex. |
| D-1 | 0.5 | 848 | 723 | 17 | 0.85 | 3496 | 2981 | 2.4 | VG | Inv. ex. |
| D-2 | 0.5 | 827 | 519 | 17 | 0.63 | 3410 | 2140 | 2.5 | G | Comp. ex. |
| E-1 | 0.5 | 861 | 684 | 16 | 0.79 | 3444 | 2736 | 2.4 | VG | Inv. ex. |
| E-2 | 0.5 | 836 | 487 | 17 | 0.58 | 3447 | 2008 | 1.7 | P | Comp. ex. |
| E-3 | 0.5 | 866 | 701 | 11 | 0.81 | 2872 | 2325 | 2.6 | VG | Comp. ex. |
| F-1 | 0.5 | 845 | 702 | 17 | 0.83 | 3484 | 2894 | 1.9 | VG | Inv. ex. |
| F-2 | 0.5 | 853 | 545 | 12 | 0.64 | 2955 | 1888 | 1.9 | G | Comp. ex. |
| G-1 | 0.5 | 902 | 494 | 14 | 0.55 | 3375 | 1848 | 1.7 | P | Comp. ex. |
| G-2 | 0.5 | 965 | 543 | 9 | 0.56 | 2895 | 1629 | 1.9 | P | Comp. ex. |
| H-1 | 0.5 | 1059 | 846 | 12 | 0.80 | 3668 | 2931 | 2.6 | VG | Inv. ex. |
| H-2 | 0.5 | 1065 | 663 | 13 | 0.62 | 3840 | 2390 | 1.9 | P | Comp. ex. |
| I-1 | 0.5 | 1033 | 920 | 13 | 0.89 | 3725 | 3317 | 3.0 | VG | Inv. ex. |
| I-2 | 0.5 | 991 | 588 | 12 | 0.59 | 3433 | 2037 | 2.1 | P | Comp. ex. |

TABLE 2-continued

| | Skin-pass reduction rate % | TS, MPa | YS, MPa | El % | YR | TS * El$^{1/2}$ | YR * TS * El$^{1/2}$ | (110)* | Spot weldability | Remarks |
|---|---|---|---|---|---|---|---|---|---|---|
| J-1 | 0.5 | 1070 | 865 | 12 | 0.81 | 3707 | 2996 | 3.1 | VG | Inv. ex. |
| J-2 | 0.5 | 1243 | 945 | 4 | 0.76 | 2486 | 1890 | 1.6 | P | Comp. ex. |
| K-1 | 0.3 | 1167 | 879 | 12 | 0.75 | 4043 | 3045 | 2.9 | VG | Inv. ex. |
| K-2 | 0.3 | 1211 | 956 | 4 | 0.79 | 2422 | 1912 | 3.0 | VG | Comp. ex. |
| L-1 | 0.3 | 1110 | 887 | 14 | 0.80 | 4153 | 3319 | 2.6 | VG | Inv. ex. |
| L-2 | 0.3 | 1105 | 712 | 9 | 0.64 | 3315 | 2136 | 2.6 | VG | Comp. ex. |
| M-1 | 0.3 | 1238 | 906 | 10 | 0.73 | 3915 | 2865 | 3.6 | VG | Inv. ex. |
| M-2 | 0.3 | 1252 | 970 | 6 | 0.77 | 3067 | 2376 | 2.5 | P | Comp. ex. |
| N-1 | 0.3 | 1180 | 977 | 12 | 0.83 | 4088 | 3384 | 2.3 | VG | Inv. ex. |
| N-2 | 0.3 | 1196 | 1126 | 3 | 0.94 | 2072 | 1950 | 2.1 | G | Comp. ex. |
| O-1 | 0.3 | 1204 | 969 | 11 | 0.80 | 3993 | 3214 | 2.6 | VG | Inv. ex. |
| O-2 | 0.3 | 1281 | 965 | 8 | 0.78 | 3623 | 2729 | 1.4 | P | Comp. ex. |
| P-1 | 0.2 | 1513 | 1218 | 7 | 0.81 | 4003 | 3223 | 2.3 | VG | Inv. ex. |
| P-2 | 0.2 | 1553 | 1201 | 5 | 0.77 | 3473 | 2686 | 1.4 | P | Comp. ex. |

*(110) is X-ray planar intensity ratio at ⅛ of thickness of sheet

Example 2

Each of the hot-rolled steel sheets of Example 1 was run through a continuous alloying hot-dip galvanizing facility for heat treatment and hot-dip galvanizing. At this time, the maximum peak temperature was made 850° C. The sheet was raised in temperature by a heating rate of 20° C./sec to 740° C., then raised in temperature by a rate of temperature rise of 2° C./sec to 850° C., then cooled by a cooling rate of 0.2° C./sec to 830° C., then cooled by a cooling rate of 2° C./sec to 460° C.

Next, the sheet was dipped in a coating tank (bath composition: 0.11%Al-Zn, bath temperature: 460° C.), then heated by a rate of temperature rise of 3° C./sec to a temperature of 520° C. to 550° C. shown in Table 3, held at 30 sec for alloying treatment, then cooled.

The basis weight of the coating was made, on both sides, about 50 g/m$^2$. The skin-pass reduction rate was as shown in Table 3.

JIS No. 5 tensile strength test pieces were obtained from each of these steel sheets and measured for tensile properties in a direction perpendicular to the rolling direction. The tensile properties, coatability, alloying reactivity, and spot weldability of the steel sheets are shown in Table 3.

The spot weldability was evaluated in the same way as in Example 1. The coatability and alloying reactivity were evaluated in the following way.

Coatability

G (good): no noncoating

F (fair): some noncoating

P (poor): much noncoating

Alloying reactivity

G (good): no uneven alloying in surface appearance

F (fair): some uneven alloying in surface appearance

P (poor): much uneven alloying in surface appearance

The invention steels satisfying the requirements of the present invention are superior to the comparative steels in the yield ratio and weldability and strength balance.

TABLE 3

| | Alloying temperature, ° C. | Skin-pass reduction rate, % | TS, MPa | YS, MPa | El % | YR | TS * El$^{1/2}$ | YR * TS * El$^{1/2}$ | (110)* | Spot weld-ability | Coatability | Alloying reaction | Remarks |
|---|---|---|---|---|---|---|---|---|---|---|---|---|---|
| A-1 | 520 | 1.0 | 811 | 674 | 18 | 0.83 | 3441 | 2860 | 2.3 | VG | G | G | Inv. ex. |
| A-2 | 520 | 1.0 | 754 | 506 | 19 | 0.67 | 3287 | 2206 | 0.9 | G | G | G | Comp. ex. |
| B-1 | 520 | 1.0 | 815 | 699 | 17 | 0.86 | 3360 | 2882 | 2.5 | VG | G | G | Inv. ex. |
| B-2 | 520 | 1.0 | 781 | 512 | 17 | 0.66 | 3220 | 2111 | 2.5 | G | G | G | Comp. ex. |
| C-1 | 520 | 1.0 | 843 | 700 | 17 | 0.83 | 3476 | 2886 | 2.6 | VG | G | G | Inv. ex. |
| C-2 | 520 | 1.0 | 822 | 529 | 16 | 0.64 | 3288 | 2116 | 1.5 | G | G | G | Comp. ex. |
| D-1 | 520 | 1.0 | 819 | 683 | 18 | 0.83 | 3475 | 2898 | 2.4 | VG | G | G | Inv. ex. |
| D-2 | 520 | 1.0 | 788 | 495 | 18 | 0.63 | 3343 | 2100 | 1.8 | G | G | F | Comp. ex. |
| E-1 | 520 | 1.0 | 820 | 695 | 17 | 0.85 | 3381 | 2866 | 2.5 | VG | G | G | Inv. ex. |
| E-2 | 520 | 1.0 | 765 | 448 | 19 | 0.59 | 3335 | 1953 | 1.3 | P | G | F | Comp. ex. |
| E-3 | 520 | 1.0 | 856 | 691 | 9 | 0.81 | 2568 | 2073 | 2.6 | VG | G | G | Comp. ex. |
| F-1 | 520 | 1.0 | 807 | 657 | 18 | 0.81 | 3424 | 2787 | 1.7 | VG | G | G | Inv. ex. |
| F-2 | 520 | 1.0 | 816 | 511 | 15 | 0.63 | 3160 | 1979 | 1.5 | G | G | F | Comp. ex. |
| G-1 | 520 | 1.0 | 859 | 506 | 15 | 0.59 | 3327 | 1960 | 1.4 | P | P | P | Comp. ex. |
| G-2 | 520 | 1.0 | 802 | 492 | 14 | 0.61 | 3001 | 1841 | 1.8 | P | G | F | Comp. ex. |
| H-1 | 540 | 0.7 | 1014 | 821 | 13 | 0.81 | 3656 | 2960 | 2.3 | VG | G | G | Inv. ex. |
| H-2 | 540 | 0.7 | 980 | 558 | 14 | 0.57 | 3667 | 2088 | 1.6 | P | P | P | Comp. ex. |
| I-1 | 540 | 0.7 | 993 | 824 | 14 | 0.83 | 3715 | 3083 | 2.9 | VG | G | G | Inv. ex. |
| I-2 | 540 | 0.7 | 944 | 505 | 14 | 0.53 | 3532 | 1890 | 1.4 | G | G | G | Comp. ex. |
| J-1 | 540 | 0.7 | 1067 | 866 | 12 | 0.81 | 3696 | 3000 | 2.9 | VG | G | G | Inv. ex. |
| J-2 | 540 | 0.7 | 1015 | 618 | 13 | 0.61 | 3660 | 2228 | 1.2 | P | G | P | Comp. ex. |
| K-1 | 550 | 0.3 | 1247 | 943 | 11 | 0.76 | 4136 | 3128 | 3.0 | VG | G | G | Inv. ex. |
| K-2 | 550 | 0.3 | 1266 | 956 | 4 | 0.76 | 2532 | 1912 | 2.6 | VG | G | G | Comp. ex. |
| L-1 | 550 | 0.3 | 1183 | 895 | 12 | 0.76 | 4098 | 3100 | 2.5 | VG | G | G | Inv. ex. |
| L-2 | 550 | 0.3 | 1122 | 714 | 10 | 0.64 | 3548 | 2258 | 2.2 | G | G | G | Comp. ex. |
| M-1 | 550 | 0.3 | 1276 | 971 | 9 | 0.76 | 3828 | 2913 | 3.4 | VG | G | G | Inv. ex. |
| M-2 | 550 | 0.3 | 1304 | 1218 | 3 | 0.93 | 2259 | 2110 | 2.2 | VG | G | G | Comp. ex. |
| N-1 | 550 | 0.3 | 1227 | 989 | 12 | 0.81 | 4250 | 3426 | 2.1 | VG | G | G | Inv. ex. |

TABLE 3-continued

| | Alloying temperature, ° C. | Skin-pass reduction rate, % | TS, MPa | YS, MPa | El % | YR | TS * El$^{1/2}$ | YR * TS * El$^{1/2}$ | (110)* | Spot weld-ability | Coatability | Alloying reaction | Remarks |
|---|---|---|---|---|---|---|---|---|---|---|---|---|---|
| N-2 | 550 | 0.3 | 1179 | 1058 | 4 | 0.90 | 2358 | 2116 | 1.9 | G | G | F | Comp. ex. |
| O-1 | 550 | 0.3 | 1234 | 1000 | 10 | 0.81 | 3902 | 3162 | 2.5 | VG | G | G | Inv. ex. |
| O-2 | 550 | 0.3 | 941 | 612 | 13 | 0.65 | 3393 | 2207 | 1.1 | P | G | F | Comp. ex. |
| P-1 | 550 | 0.2 | 1568 | 1251 | 7 | 0.80 | 4149 | 3310 | 2.3 | VG | G | G | Inv. ex. |
| P-2 | 550 | 0.2 | 1480 | 1157 | 6 | 0.78 | 3625 | 2834 | 1.2 | P | F | P | Comp. ex. |

*(110) is X-ray planar intensity ratio at ⅛ of thickness of sheet

Example 3

Among the hot-rolled steel sheets of the Example 1, a sheet of each the three types of B-1, E-2, and L-1 was run through a continuous alloying hot-dip galvanizing facility for heat treatment and hot-dip galvanizing. At this time, the maximum peak temperature was changed from 700 to 970° C.

The sheet was raised in temperature by a heating rate 20° C./sec to (maximum peak temperature−100)° C., then raised in temperature by a rate of temperature rise of 2° C./sec to maximum peak temperature, then cooled by a cooling rate of 0.2° C./sec to (maximum peak temperature−20)° C., then cooled by a cooling rate of 2° C./sec to 460° C.

Next, the sheet was dipped in a coating tank (bath composition: 0.11%Al-Zn, bath temperature: 460° C.), then raised in temperature by a rate of temperature rise of 3° C./sec, then heated to a temperature of 520° C. to 550° C. shown in Table 4, held there for 30 sec for alloying treatment, then cooled.

The basis weight of the coating was made, on both sides, about 50 g/m$^2$. The skin-pass reduction rate was as shown in Table 4.

When satisfying the requirements of the present invention, the sheets are higher in yield ratio and superior in weldability compared with the comparative examples.

TABLE 4

| | Maximum peak temperature, ° C. | Alloying temperature, ° C. | Skin-pass reduction rate, % | TS, MPa | YS, MPa | El % | YR | TS * EL$^{1/2}$ | YR * TS * El$^{1/2}$ | (110)* | Spot weld-ability | Remarks |
|---|---|---|---|---|---|---|---|---|---|---|---|---|
| B-1 | 700 | 520 | 0.5 | 784 | 687 | 18 | 0.88 | 3326 | 2915 | 2.4 | VG | Inv. ex. |
| | 800 | 520 | 0.5 | 822 | 716 | 17 | 0.87 | 3389 | 2952 | 2.6 | VG | Inv. ex. |
| | 840 | 520 | 0.5 | 819 | 704 | 17 | 0.86 | 3377 | 2903 | 2.5 | VG | Inv. ex. |
| | 880 | 520 | 0.5 | 795 | 655 | 18 | 0.82 | 3373 | 2779 | 2.4 | VG | Inv. ex. |
| | 970 | 520 | 0.5 | 747 | 495 | 20 | 0.66 | 3341 | 2214 | 2.0 | VG | Comp. ex. |
| E-2 | 700 | 550 | 0.5 | 714 | 447 | 21 | 0.63 | 3272 | 2048 | 1.6 | P | Comp. ex. |
| | 800 | 550 | 0.5 | 746 | 478 | 19 | 0.64 | 3252 | 2084 | 1.5 | P | Comp. ex. |
| | 840 | 550 | 0.5 | 766 | 469 | 18 | 0.61 | 3250 | 1990 | 1.4 | P | Comp. ex. |
| | 880 | 550 | 0.5 | 703 | 423 | 20 | 0.60 | 3144 | 1892 | 1.2 | P | Comp. ex. |
| | 970 | 550 | 0.5 | 668 | 382 | 22 | 0.57 | 3133 | 1792 | 0.9 | P | Comp. ex. |
| L-1 | 700 | 550 | 0.3 | 1054 | 894 | 14 | 0.85 | 3944 | 3345 | 2.4 | VG | Inv. ex. |
| | 800 | 550 | 0.3 | 1184 | 921 | 13 | 0.78 | 4269 | 3321 | 2.7 | VG | Inv. ex. |
| | 840 | 550 | 0.3 | 1179 | 902 | 12 | 0.77 | 4084 | 3125 | 2.6 | VG | Inv. ex. |
| | 880 | 550 | 0.3 | 1196 | 920 | 12 | 0.77 | 4143 | 3187 | 2.5 | VG | Inv. ex. |
| | 970 | 550 | 0.3 | 1042 | 668 | 13 | 0.64 | 3757 | 2409 | 2.5 | VG | Comp. ex. |

*(110) is X-ray planar intensity ratio at ⅛ of thickness of sheet

Example 4

Each of the samples E-1, E-2, I-1, I-2, L-1, and L-2 of Table 1 was treated in the same way as in Example 2 up to dipping in the coating tank, then was air cooled until room temperature. The basis weight of the coating was made, on both sides, about 45 g/m . The skin-pass reduction rate was as shown in Table 5.

The invention steels satisfying the requirements of the present invention are superior to the comparative steels in the yield ratio and weldability and strength balance.

TABLE 5

| | Skin-pass reduction rate, % | TS, MPa | YS, MPa | El % | YR | TS * El$^{1/2}$ | YR * TS * El$^{1/2}$ | (110)* | Spot weldability | Coatability | Remarks |
|---|---|---|---|---|---|---|---|---|---|---|---|
| E-1 | 1.0 | 833 | 708 | 17 | 0.85 | 3435 | 2919 | 2.6 | VG | G | Inv. ex. |
| E-2 | 1.0 | 771 | 428 | 18 | 0.56 | 3271 | 1816 | 1.3 | P | G | Comp. ex. |
| I-1 | 0.7 | 1015 | 802 | 14 | 0.79 | 3798 | 3001 | 2.8 | VG | G | Inv. ex. |
| I-2 | 0.7 | 956 | 486 | 14 | 0.51 | 3577 | 1818 | 1.3 | P | G | Comp. ex. |

TABLE 5-continued

| | Skin-pass reduction rate, % | TS, MPa | YS, MPa | El % | YR | TS * El$^{1/2}$ | YR * TS * El$^{1/2}$ | (110)* | Spot weldability | Coatability | Remarks |
|---|---|---|---|---|---|---|---|---|---|---|---|
| L-1 | 0.3 | 1211 | 925 | 12 | 0.76 | 4195 | 3204 | 2.5 | VG | G | Inv. ex. |
| L-2 | 0.3 | 1144 | 715 | 10 | 0.63 | 3618 | 2261 | 2.3 | P | G | Comp. ex. |

*(110) is X-ray planar intensity ratio at ⅛ of thickness of sheet

Examples 5 to 7 are cold-rolled steel sheets of the present invention.

Example 5

Each of the chemical compositions shown in Table 6 was adjusted in the converter to obtain a slab. The slab was heated to 1250° C., hot-rolled ending at more than the $Ar_3$ transformation temperature, that is, 880° C. to 910° C., to a steel sheet of a thickness of 3.0 mm, and coiled at 550° C.

This steel sheet was pickled, then cold-rolled to a sheet thickness of 1.4 mm.

Next, heat treatment was performed under the conditions shown in Table 7. The sheet was held at the maximum peak temperature for 90 sec and cooled down to the (maximum peak temperature−130)° C. at 5° C./sec. After this, the sheet was cooled to the additional heat treatment temperature by 30° C./sec and subjected to additional heat treatment for about 250 sec. The skin-pass reduction rate is as shown in Table 7.

JIS No. 5 tensile strength test pieces were obtained from this steel sheet and measured for tensile properties in a direction perpendicular to the rolling direction. The spot welding was performed under the next conditions (a) to (e).

(a) Electrode (dome type): tip diameter 6 mmϕ

(b) Applied pressure: 4.3 kN (c) Welding current: (CE) right before expulsion and surface flash and (CE+1.5)kA (d) Welding time: 15 cycles (e) Holding time: 10 cycles After welding, JIS Z 3137 was used for a cross-joint tensile test. When indexed to the minimum value of CTS when welding test pieces by a welding current of CE 10 times as "1", a minimum value of the CTS when welding by a welding current of the region of occurrence of expulsion and surface flash, that is, (CE+1.5)kA, of less than 0.7 is evaluated as P (poor), of 0.7 to less than 0.8 as G (good), and of 0.8 or more as VG (very good).

The steel sheet of the present invention is superior in weldability, high in yield ratio, and relatively superior in ductility as well.

TABLE 6

| | C | Si | Mn | P | S | Al | N | Ti | Nb | Mo | B | Others | Remarks |
|---|---|---|---|---|---|---|---|---|---|---|---|---|---|
| A-1 | 0.033 | 0.59 | 2.10 | 0.005 | 0.0022 | 0.031 | 0.0026 | 0.022 | 0.019 | 0.29 | 0.0030 | | Inv. ex. |
| A-2 | 0.034 | 0.57 | 2.09 | 0.004 | 0.0028 | 0.030 | 0.0025 | 0.003 | 0.020 | 0.30 | 0.0028 | | Comp. ex. |
| B-1 | 0.035 | 0.54 | 2.10 | 0.004 | 0.0028 | 0.026 | 0.0024 | 0.017 | 0.030 | 0.20 | 0.0020 | | Inv. ex. |
| B-2 | 0.035 | 0.55 | 2.12 | 0.005 | 0.0025 | 0.029 | 0.0030 | 0.019 | 0.020 | 0.30 | — | | Comp. ex. |
| C-1 | 0.052 | 0.54 | 2.13 | 0.006 | 0.0031 | 0.028 | 0.0020 | 0.019 | 0.022 | 0.14 | 0.0019 | | Inv. ex. |
| C-2 | 0.050 | 0.54 | 2.08 | 0.005 | 0.0020 | 0.024 | 0.0025 | 0.020 | — | 0.15 | 0.0020 | | Comp. ex. |
| D-1 | 0.044 | 0.55 | 2.14 | 0.004 | 0.0026 | 0.025 | 0.0031 | 0.022 | 0.021 | 0.15 | 0.0022 | | Inv. ex. |
| D-2 | 0.042 | 0.56 | 2.16 | 0.005 | 0.0025 | 0.027 | 0.0022 | 0.015 | 0.019 | — | 0.0033 | | Comp. ex. |
| E-1 | 0.050 | 0.55 | 2.00 | 0.003 | 0.0024 | 0.030 | 0.0025 | 0.025 | 0.018 | 0.16 | 0.0030 | | Inv. ex. |
| E-2 | 0.050 | 0.55 | 2.01 | 0.004 | 0.0024 | 0.027 | 0.0023 | 0.023 | 0.021 | — | — | | Comp. ex. |
| E-3 | 0.049 | 0.28 | 1.98 | 0.004 | 0.0026 | 0.030 | 0.0028 | 0.024 | 0.019 | 0.15 | 0.0027 | | Comp. ex. |
| F-1 | 0.047 | 0.60 | 1.84 | 0.005 | 0.0019 | 0.034 | 0.0026 | 0.021 | 0.026 | 0.25 | 0.0024 | Cr = 0.46 | Inv. ex. |
| F-2 | 0.046 | 0.62 | 1.66 | 0.006 | 0.0030 | 0.024 | 0.0028 | 0.024 | 0.024 | 0.30 | 0.0030 | Cr = 0.67 | Comp. ex. |
| G-1 | 0.062 | 0.84 | 2.09 | 0.011 | 0.0016 | 0.029 | 0.0028 | 0.020 | 0.042 | 0.14 | — | | Comp. ex. |
| G-2 | 0.111 | 0.01 | 1.74 | 0.008 | 0.0026 | 0.030 | 0.0025 | 0.011 | 0.042 | — | — | | Comp. ex. |
| H-1 | 0.070 | 0.55 | 2.41 | 0.008 | 0.0023 | 0.022 | 0.0024 | 0.020 | 0.052 | 0.09 | 0.0011 | | Inv. ex. |
| H-2 | 0.075 | 1.33 | 2.25 | 0.008 | 0.0024 | 0.020 | 0.0029 | 0.020 | 0.020 | 0.08 | 0.0009 | | Comp. ex. |
| I-1 | 0.060 | 0.60 | 2.10 | 0.007 | 0.0020 | 0.034 | 0.0026 | 0.020 | 0.020 | 0.30 | 0.0030 | | Inv. ex. |
| I-2 | 0.061 | 0.58 | 2.08 | 0.006 | 0.0024 | 0.030 | 0.0034 | — | — | 0.35 | 0.0033 | | Comp. ex. |
| J-1 | 0.050 | 0.59 | 2.49 | 0.007 | 0.0021 | 0.030 | 0.0030 | 0.020 | 0.050 | 0.15 | 0.0031 | | Inv. ex. |
| J-2 | 0.123 | 0.52 | 2.51 | 0.007 | 0.0022 | 0.021 | 0.0027 | — | — | — | — | | Comp. ex. |
| K-1 | 0.085 | 0.60 | 2.52 | 0.004 | 0.0032 | 0.029 | 0.0023 | 0.019 | 0.021 | 0.15 | 0.0025 | | Inv. ex. |
| K-2 | 0.090 | 0.01 | 2.60 | 0.004 | 0.0029 | 0.028 | 0.0026 | 0.041 | 0.016 | 0.15 | 0.0023 | | Comp. ex. |
| L-1 | 0.081 | 0.61 | 2.49 | 0.011 | 0.0027 | 0.029 | 0.0027 | 0.020 | 0.022 | 0.14 | 0.0025 | Cr = 0.40 | Inv. ex. |
| L-2 | 0.082 | 0.60 | 2.50 | 0.008 | 0.0031 | 0.027 | 0.0028 | 0.022 | 0.020 | 0.15 | — | Cr = 0.40 | Comp. ex. |
| M-1 | 0.074 | 0.55 | 2.65 | 0.003 | 0.0020 | 0.024 | 0.0021 | 0.023 | 0.040 | 0.30 | 0.0032 | | Inv. ex. |
| M-2 | 0.076 | 0.55 | 2.66 | 0.005 | 0.0019 | 0.025 | 0.0028 | 0.020 | 0.068 | 0.29 | 0.0026 | Sn = 0.03 | Comp. ex. |
| N-1 | 0.089 | 0.60 | 2.44 | 0.004 | 0.0021 | 0.027 | 0.0026 | 0.018 | 0.022 | 0.15 | 0.0019 | | Inv. ex. |
| N-2 | 0.091 | 0.60 | 2.45 | 0.004 | 0.0018 | 0.030 | 0.0022 | 0.122 | 0.021 | 0.16 | 0.0022 | Cr = 0.11 | Comp. ex. |
| O-1 | 0.079 | 0.58 | 2.51 | 0.004 | 0.0026 | 0.033 | 0.0028 | 0.015 | 0.016 | 0.15 | 0.0016 | V = 0.07 | Inv. ex. |
| O-2 | 0.150 | 0.51 | 2.62 | 0.006 | 0.0022 | 0.026 | 0.0033 | — | — | — | — | | Comp. ex. |
| P-1 | 0.096 | 0.58 | 3.05 | 0.006 | 0.0023 | 0.007 | 0.0029 | 0.034 | 0.019 | 0.40 | 0.0028 | V = 0.040 | Inv. ex. |
| P-2 | 0.153 | 0.72 | 2.98 | 0.007 | 0.0026 | 0.011 | 0.0025 | 0.016 | — | 0.09 | — | Ca = 0.0022 | Comp. ex. |

TABLE 7

| | Maximum peak temperature, ° C. | Additional heat treatment temperature, ° C. | Skin-pass reduction rate, % | TS, MPa | YS, MPa | El % | TS * El$^{1/2}$ | YR | YR * TS * El$^{1/2}$ | (110)* | Spot weldability | Remarks |
|---|---|---|---|---|---|---|---|---|---|---|---|---|
| A-1 | 840 | 400 | 1.0 | 844 | 697 | 17 | 3480 | 0.83 | 2874 | 0.4 | VG | Inv. ex. |
| A-2 | 840 | 400 | 1.0 | 825 | 522 | 17 | 3402 | 0.63 | 2152 | 0.4 | G | Comp. ex. |
| B-1 | 840 | 380 | 1.0 | 820 | 665 | 17 | 3381 | 0.81 | 2742 | 0.5 | VG | Inv. ex. |
| B-2 | 840 | 380 | 1.0 | 835 | 544 | 17 | 3443 | 0.65 | 2243 | 0.8 | P | Comp. ex. |
| C-1 | 850 | 250 | 1.0 | 879 | 702 | 15 | 3404 | 0.80 | 2719 | 0.3 | VG | Inv. ex. |
| C-2 | 850 | 250 | 1.0 | 894 | 566 | 16 | 3576 | 0.63 | 2264 | 0.6 | G | Comp. ex. |
| D-1 | 820 | 400 | 1.0 | 825 | 683 | 17 | 3402 | 0.83 | 2816 | 0.4 | VG | Inv. ex. |
| D-2 | 820 | 400 | 1.0 | 817 | 502 | 18 | 3466 | 0.61 | 2130 | 0.4 | G | Comp. ex. |
| E-1 | 850 | 350 | 1.0 | 864 | 689 | 15 | 3346 | 0.80 | 2668 | 0.5 | VG | Inv. ex. |
| E-2 | 850 | 350 | 1.0 | 850 | 499 | 17 | 3505 | 0.59 | 2057 | U | P | Comp. ex. |
| E-3 | 850 | 350 | 1.0 | 878 | 694 | 11 | 2912 | 0.79 | 2302 | 0.5 | VG | Comp. ex. |
| F-1 | 780 | 300 | 1.0 | 845 | 708 | 17 | 3484 | 0.84 | 2919 | 0.5 | VG | Inv. ex. |
| F-2 | 780 | 300 | 1.0 | 847 | 535 | 13 | 3054 | 0.63 | 1929 | 0.6 | G | Comp. ex. |
| G-1 | 800 | 400 | 1.0 | 932 | 479 | 15 | 3610 | 0.51 | 1855 | 0.6 | G | Comp. ex. |
| G-2 | 800 | 400 | 1.0 | 953 | 528 | 14 | 3566 | 0.55 | 1976 | U | P | Comp. ex. |
| H-1 | 880 | 240 | 0.7 | 1066 | 810 | 11 | 3536 | 0.76 | 2686 | 0.7 | VG | Inv. ex. |
| H-2 | 880 | 240 | 0.7 | 1085 | 522 | 13 | 3912 | 0.48 | 1882 | 0.8 | P | Comp. ex. |
| I-1 | 840 | 400 | 0.7 | 1089 | 947 | 12 | 3772 | 0.87 | 3281 | 0.3 | VG | Inv. ex. |
| I-2 | 840 | 400 | 0.7 | 1051 | 604 | 11 | 3486 | 0.57 | 2003 | 0.5 | G | Comp. ex. |
| J-1 | 840 | 250 | 0.7 | 1058 | 846 | 12 | 3665 | 0.80 | 2931 | 0.2 | VG | Inv. ex. |
| J-2 | 840 | 250 | 0.7 | 1144 | 882 | 5 | 2558 | 0.77 | 1972 | 0.4 | P | Comp. ex. |
| K-1 | 800 | 400 | 0.3 | 1237 | 954 | 11 | 4103 | 0.77 | 3164 | 0.4 | VG | Inv. ex. |
| K-2 | 800 | 400 | 0.3 | 1242 | 942 | 4 | 2484 | 0.76 | 1884 | 0.6 | VG | Comp. ex. |
| L-1 | 860 | 400 | 0.3 | 1244 | 954 | 10 | 3934 | 0.77 | 3017 | 0.5 | VG | Inv. ex. |
| L-2 | 860 | 400 | 0.3 | 1276 | 910 | 4 | 2552 | 0.71 | 1820 | 0.8 | G | Comp. ex. |
| M-1 | 850 | 350 | 0.3 | 1240 | 900 | 10 | 3921 | 0.73 | 2846 | 0.4 | VG | Inv. ex. |
| M-2 | 850 | 350 | 0.3 | 1255 | 963 | 5 | 2806 | 0.77 | 2153 | 0.5 | P | Comp. ex. |
| N-1 | 840 | 200 | 0.3 | 1264 | 1005 | 11 | 4192 | 0.80 | 3333 | 0.4 | VG | Inv. ex. |
| N-2 | 840 | 200 | 0.3 | 1331 | 1210 | 3 | 2305 | 0.91 | 2096 | 0.4 | G | Comp. ex. |
| O-1 | 880 | 250 | 0.3 | 1258 | 972 | 11 | 4172 | 0.77 | 3224 | 0.3 | VG | Inv. ex. |
| O-2 | 880 | 250 | 0.3 | 1270 | 931 | 9 | 3810 | 0.73 | 2793 | U | P | Comp. ex. |
| P-1 | 870 | 160 | 0.2 | 1619 | 1356 | 6 | 3966 | 0.84 | 3322 | 0.2 | VG | Inv. ex. |
| P-2 | 870 | 160 | 0.2 | 1538 | 1206 | 5 | 3439 | 0.78 | 2697 | 0.9 | P | Comp. ex. |

*(110) is X-ray planar intensity ratio at ⅛ of thickness of sheet

Example 6

Steel was treated by the same procedure as with Example 5 until the cold-rolling. Each cold-rolled steel sheet was run through a continuous alloying hot-dip galvanizing facility for heat treatment and hot-dip galvanizing. At this, the maximum peak temperature was changed in various ways.

Each sheet was raised in temperature by a heating rate of 20° C./sec until (maximum peak temperature−120)° C., then was raised in temperature by a rate of temperature rise of 2° C./sec until the maximum peak temperature, then was cooled by a cooling rate of 0.2° C./sec to (maximum peak temperature−20)° C., then was cooled by a cooling rate of 2° C./sec to 620° C., then was further cooled by a cooling rate of 4° C./sec to 500° C., then was cooled by a cooling rate of 2° C./sec to 470° C.

Next, the sheet was dipped in a coating tank (bath composition: 0.11%Al-Zn, bath temperature: 470° C.), then was heated by a rate of temperature rise of 3° C./sec to 520° C. to 550° C., held there for 30 sec for alloying treatment, then cooled. The basis weight of the coating was made, on both sides, about 60 g/m$^2$. The skin-pass reduction rate was as shown in Table 8.

JIS No. 5 tensile strength test pieces were obtained from each of these steel sheets and measured for tensile properties in a direction perpendicular to the rolling direction. The tensile properties, coatability, alloying reactivity, and spot weldability of the steel sheets are shown in Table 8. The spot weldability was evaluated in the same way as in Example 5. The coatability and alloying reactivity were evaluated as follows.

Coatability

G (good): no noncoating

F (fair): some noncoating

P (poor): much noncoating

Alloying Reactivity

G (good); no uneven alloying in surface appearance

F (fair): some-uneven alloying in surface appearance

P (poor): much uneven alloying in surface appearance

The invention steels satisfying the requirements of the present invention are superior to the comparative steels in the yield ratio and weldability and strength balance.

TABLE 8

| | Maximum peak temp., ° C. | Alloying temp., ° C. | Skin-pass reduction rate, % | TS, Mpa | YS, Mpa | El % | TS * El$^{1/2}$ | YR | YR * TS * El$^{1/2}$ |
|---|---|---|---|---|---|---|---|---|---|
| A-1 | 840 | 520 | 1.0 | 823 | 640 | 17 | 3393 | 0.78 | 2639 |
| A-2 | 840 | 520 | 1.0 | 819 | 518 | 18 | 3475 | 0.63 | 2198 |
| B-1 | 870 | 520 | 1.0 | 813 | 621 | 18 | 3449 | 0.76 | 2635 |
| B-2 | 870 | 520 | 1.0 | 816 | 516 | 18 | 3462 | 0.63 | 2189 |
| C-1 | 870 | 520 | 1.0 | 848 | 653 | 16 | 3392 | 0.77 | 2612 |
| C-2 | 870 | 520 | 1.0 | 841 | 521 | 16 | 3364 | 0.62 | 2084 |

TABLE 8-continued

| | | | | | | | | | |
|---|---|---|---|---|---|---|---|---|---|
| D-1 | 820 | 520 | 1.0 | 815 | 645 | 18 | 3458 | 0.79 | 2737 |
| D-2 | 820 | 520 | 1.0 | 796 | 483 | 19 | 3470 | 0.61 | 2105 |
| E-1 | 850 | 520 | 1.0 | 834 | 638 | 16 | 3336 | 0.76 | 2652 |
| E-2 | 850 | 520 | 1.0 | 815 | 479 | 18 | 3458 | 0.69 | 2032 |
| E-3 | 850 | 520 | 1.0 | 831 | 635 | 13 | 2996 | 0.76 | 2290 |
| F-1 | 790 | 520 | 1.0 | 827 | 622 | 18 | 3509 | 0.75 | 2639 |
| F-2 | 790 | 520 | 1.0 | 820 | 545 | 14 | 3068 | 0.66 | 2039 |
| G-1 | 860 | 520 | 1.0 | 868 | 516 | 15 | 3362 | 0.59 | 1998 |
| G-2 | 860 | 520 | 1.0 | 852 | 509 | 16 | 3408 | 0.60 | 2036 |
| H-1 | 850 | 540 | 0.7 | 1032 | 670 | 12 | 3575 | 0.65 | 2321 |
| H-2 | 850 | 540 | 0.7 | 1017 | 524 | 14 | 3805 | 0.52 | 1961 |
| I-1 | 840 | 540 | 0.7 | 999 | 806 | 13 | 3602 | 0.81 | 2906 |
| I-2 | 840 | 540 | 0.7 | 889 | 539 | 13 | 3205 | 0.61 | 1943 |
| J-1 | 840 | 540 | 0.7 | 1028 | 820 | 12 | 3561 | 0.80 | 2841 |
| J-2 | 840 | 540 | 0.7 | 1056 | 602 | 14 | 3951 | 0.57 | 2252 |
| K-1 | 800 | 550 | 0.3 | 1215 | 919 | 11 | 4030 | 0.76 | 3048 |
| K-2 | 800 | 550 | 0.3 | 1193 | 901 | 7 | 3156 | 0.76 | 2384 |
| L-1 | 860 | 550 | 0.3 | 1260 | 963 | 10 | 3953 | 0.77 | 3045 |
| L-2 | 860 | 550 | 0.3 | 1185 | 701 | 10 | 3747 | 0.69 | 2217 |
| M-1 | 810 | 550 | 0.3 | 1218 | 886 | 11 | 4040 | 0.73 | 2939 |
| M-2 | 810 | 550 | 0.3 | 1227 | 954 | 7 | 3246 | 0.878 | 2524 |
| N-1 | 820 | 550 | 0.3 | 1204 | 933 | 13 | 4341 | 0.77 | 3364 |
| N-2 | 820 | 550 | 0.3 | 1336 | 1185 | 4 | 2632 | 0.90 | 2370 |
| O-1 | 880 | 550 | 0.3 | 1092 | 816 | 14 | 4086 | 0.75 | 3053 |
| O-2 | 880 | 550 | 0.3 | 1170 | 696 | 14 | 4218 | 0.59 | 2509 |
| P-1 | 870 | 550 | 0.2 | 1526 | 1204 | 7 | 4037 | 0.79 | 3185 |
| P-2 | 870 | 550 | 0.2 | 1471 | 901 | 7 | 3892 | 0.61 | 2384 |

| | (110)* | Spot weldability | Coatability | Alloying reaction | Remarks |
|---|---|---|---|---|---|
| A-1 | 0.3 | VG | G | G | Inv. ex. |
| A-2 | 0.4 | G | G | G | Comp. ex. |
| B-1 | 0.4 | VG | G | G | Inv. ex. |
| B-2 | 0.6 | P | G | F | Comp. ex. |
| C-1 | 0.5 | VG | G | G | Inv. ex. |
| C-2 | 0.7 | G | G | G | Comp. ex. |
| D-1 | 0.5 | VG | G | G | Inv. ex. |
| D-2 | 0.6 | P | G | G | Comp. ex. |
| E-1 | 0.5 | VG | G | G | Inv. ex. |
| E-2 | 1.2 | P | G | F | Comp. ex. |
| E-3 | 0.6 | VG | G | G | Comp. ex. |
| F-1 | 0.3 | VG | G | G | Inv. ex. |
| F-2 | 0.5 | G | G | G | Comp. ex. |
| G-1 | 0.4 | P | F | F | Comp. ex. |
| G-2 | 1.1 | P | G | G | Comp. ex. |
| H-1 | 0.5 | VG | G | G | Inv. ex. |
| H-2 | 0.6 | P | P | P | Comp. ex. |
| I-1 | 0.3 | VG | G | G | Inv. ex. |
| I-2 | 0.6 | G | G | G | Comp. ex. |
| J-1 | 0.2 | VG | G | G | Inv. ex. |
| J-2 | 0.4 | P | G | F | Comp. ex. |
| K-1 | 0.3 | VG | G | G | Inv. ex. |
| K-2 | 0.6 | VG | G | G | Comp. ex. |
| L-1 | 0.7 | VG | G | G | Inv. ex. |
| L-2 | 1.1 | G | G | F | Comp. ex. |
| M-1 | 0.2 | VG | G | G | Inv. ex. |
| M-2 | 0.4 | P | G | G | Comp. ex. |
| N-1 | 0.3 | VG | G | G | Inv. ex. |
| N-2 | 0.4 | G | G | G | Comp. ex. |
| O-1 | 0.7 | VG | G | G | Inv. ex. |
| O-2 | 1.2 | P | G | F | Comp. ex. |
| P-1 | 0.3 | VG | G | G | Inv. ex. |
| P-2 | 0.9 | G | G | f | Comp. ex. |

*(110) is X-ray planar intensity ratio at ⅛ of thickness of sheet

Example 7

Each of the samples E-1, E-2, I-1, I-2, L-1, and L-2 in Table 6 was treated in the same way as in Example 6 up until dipping in the coating tank, then was air cooled to room temperature. The basis weight of the coating was made, on both sides, about 45 g/m$^2$. The skin-pass reduction rate was as shown in Table 9.

The invention steels satisfying the requirements of the present invention are superior to the comparative steels in the yield ratio and weldability and strength balance.

TABLE 9

| | Maximum peak temperature ° C. | Skin-pass reduction rate, % | TS, Mpa | YS, Mpa | El, % | TS * El$^{1/2}$ | YR | YR * TS * El$^{1/2}$ | (110)* | Spot weldability | Coatability | Remarks |
|---|---|---|---|---|---|---|---|---|---|---|---|---|
| E-1 | 850 | 1.0 | 846 | 632 | 16 | 3384 | 0.75 | 2528 | 0.4 | VG | G | Inv. ex. |
| E-2 | 850 | 1.0 | 822 | 449 | 18 | 3487 | 0.55 | 1905 | 1.1 | P | G | Comp. ex. |
| I-1 | 840 | 0.7 | 1008 | 816 | 13 | 23634 | 0.81 | 2942 | 0.4 | VG | G | Inv. ex. |
| I-2 | 840 | 0.7 | 916 | 565 | 13 | 3303 | 0.62 | 2037 | 0.6 | G | G | Comp. ex. |
| L-1 | 860 | 0.3 | 1248 | 944 | 10 | 3947 | 0.76 | 2985 | 0.6 | VG | G | Inv. ex. |
| L-2 | 860 | 0.3 | 1190 | 677 | 10 | 3763 | 0.57 | 2131 | 0.9 | P | G | Comp. ex. |

*(110) is X-ray planar intensity ratio at ⅛ of thickness of sheet

INDUSTRIAL APPLICABILITY

According to the present invention, it is possible to obtain high yield ratio high-strength hot-rolled steel sheet and cold-rolled steel sheet with a maximum tensile strength (TS) of 780 MPa or more and superior in weldability and ductility, high yield ratio high-strength hot-dip galvanized steel sheet, and high yield ratio high-strength hot-dip galvannealed steel sheet.

Therefore, the present invention expands the applications of steel sheet and contributes to improvement of the steel industry and the industries using steel materials.

The invention claimed is:

1. High yield ratio high-strength cold-rolled steel sheet superior in spot weldability and ductility, containing, by mass %, C: over 0.030 to less than 0.10%,
Mn: 1.7 to 2.49%,
P: 0.001 to 0.02%,
S: 0.0001 to 0.006%,
Al: 0.060% or less,
N: 0.0001 to 0.0070%,
Si: 0.54 to 0.65%
Ti: 0.01 to 0.055%,
Nb: 0.012 to 0.055%,
Mo: 0.07 to 0.55%,
B: 0.0005 to 0.0040%, and simultaneously satisfying $$1.1<14\times Ti(\%)+20\times Nb(\%)+3\times Mo(\%)+300\times B(\%)\leqq 3.7,$$

the balance comprised of iron and unavoidable impurities, and having a microstructure composed of lower bainite or bainitic ferrite as a main phase which constitutes over 85% of the area of the microstructure, and having a yield ratio of more than 0.64 to less than 0.90, a TS×(E1)$^{of\ 1/2}$of 3320 or more, an YR×TS×(E1)$^{1/2}$ of 2320 or more, and a maximum tensile strength (TS) of 780 MPa or more, having a minimum value of CTS (cross-tensile strength) of 0.8 or more among 10 values of CTS obtained by welding 10 test pieces by a welding current of (CE+1.5)kA, wherein CE is welding current immediately before expulsion and surface flash, and wherein the minimum value of CTS among 10 values of obtained by welding 10 test pieces by a welding current of CE is defined as "1", and having an X-ray intensity ratio of a {110} plane parallel to the sheet surface at ⅛ the thickness of the steel sheet of less than 1.0.

2. High yield ratio high-strength cold-rolled steel sheet superior in weldability and ductility as set forth in claim 1, characterized by further containing, by mass %, one or two of Cr: 0.01 to 1.5%,
Ni: 0.01 to 2.0%,
Cu: 0.001 to 2.0%,
Co: 0.01 to 1%,
W: 0.01 to 0.3%.

3. High yield ratio high-strength hot-dip galvanized steel sheet superior in weldability and ductility, characterized by comprising cold-rolled steel sheet comprised of the chemical components described in claim 1, and hot-dip galvanized.

4. High yield ratio high-strength hot-dip galvanized steel sheet superior in weldability and ductility, characterized by comprising cold-rolled steel sheet comprised of the chemical components described in claim 1, hot-dip galvanized, and alloyed.

* * * * *